US006401497B1

(12) United States Patent
Nishiyama et al.

(10) Patent No.: US 6,401,497 B1
(45) Date of Patent: Jun. 11, 2002

(54) GARMENT WITH FIGURE CONTROL OR MUSCLE SUPPORT FUNCTION

(75) Inventors: Naruo Nishiyama; Kei Oya; Eiko Takagi, all of Kyoto; Yasuo Ishimoto, Fukui, all of (JP)

(73) Assignee: Wacoal Corp. (JP)

( * ) Notice: Subject to any disclaimer, the term of this patent is extended or adjusted under 35 U.S.C. 154(b) by 0 days.

(21) Appl. No.: 09/673,805

(22) PCT Filed: Mar. 5, 1999

(86) PCT No.: PCT/JP99/01098

§ 371 (c)(1),
(2), (4) Date: Oct. 19, 2000

(87) PCT Pub. No.: WO99/53779

PCT Pub. Date: Oct. 28, 1999

(30) Foreign Application Priority Data

Apr. 22, 1998 (JP) ..... 10-112174
Dec. 9, 1998 (JP) ..... 10-350490

(51) Int. Cl.[7] ..... D04B 9/46; D04B 21/18

(52) U.S. Cl. ..... 66/172 E; 66/171; 66/178 R; 66/182; 66/195

(58) Field of Search ..... 66/169 R, 170, 66/171, 172 E, 175, 176, 177, 178 R, 182, 178 A, 195

(56) References Cited

U.S. PATENT DOCUMENTS 5,390,512 A 2/1995 Mista ..... 66/205

FOREIGN PATENT DOCUMENTS

| | | |
|---|---|---|
| JP | 57-87005 | 11/1955 |
| JP | 47-9946 | 4/1972 |
| JP | 63-35804 | 2/1988 |
| JP | 63-85146 | 4/1988 |
| JP | 1-74210 | 5/1989 |
| JP | 5-19309 | 3/1993 |
| JP | 6-166934 | 6/1994 |
| JP | 3008737 | 12/1994 |
| JP | 3008737 | 3/1995 |
| JP | 8-311703 | 11/1996 |
| JP | 9-119003 | 5/1997 |
| JP | 9-296304 | 11/1997 |
| JP | 3046785 | 12/1997 |
| JP | 9-324304 | 12/1997 |

OTHER PUBLICATIONS

Kokai Giho No. 96–6716, Japan Institute of Invention and Innovation, May 15, 1996 (full translation).
Kokai Giho No. 96–3784, Japan Institute of Invention and Innovation, Mar. 15, 1996 (full translation).
Kokai Giho No. 98–980, Japan Institute of Innovation and Invention, Feb. 16, 1998 (full translation).
Tateami Journal, "Computer Controlled Pieze Jacquard Raschel Machine", Oct. 1, 1997.
International Search Report, PCT/JP99/01098, WO99/53779, Jun. 8, 1999.

*Primary Examiner*—Danny Worrell
(74) *Attorney, Agent, or Firm*—Morrison Law Firm

(57) ABSTRACT

A garment with a figure control or muscle support function which includes a warp knit fabric having ground stitches by jacquard knitting of inelastic yarn, in which elastic yarn is further inserted and/or knitted. Portions with relatively strong and weak straining forces are formed in the warp knit fabric in predetermined places in predetermined patterns by changing the ground stitches depending on the required strength of the straining forces. There is substantially no difference in level at a boundary between the portions with strong and weak straining forces. The fabric is thus free of a problem in which a difference in level is reflected in outer wear and degrades the wearer's appearance.

20 Claims, 30 Drawing Sheets

Fig. 11 (a)
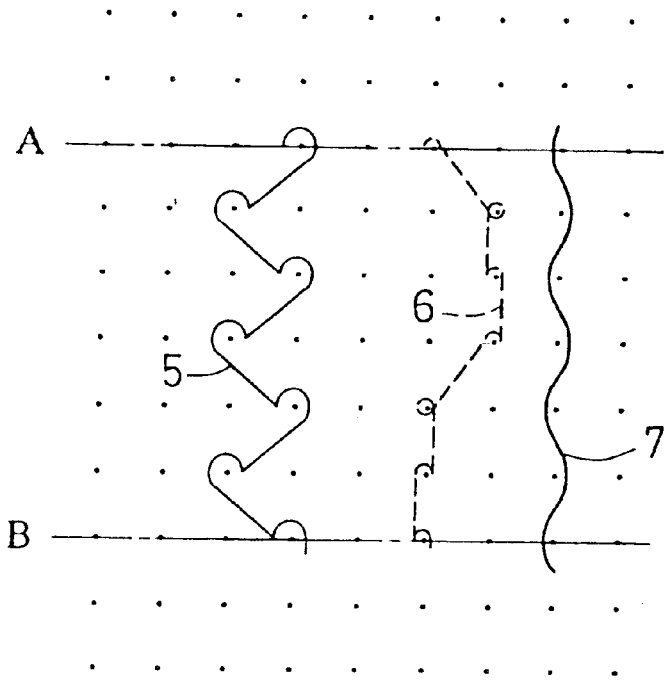
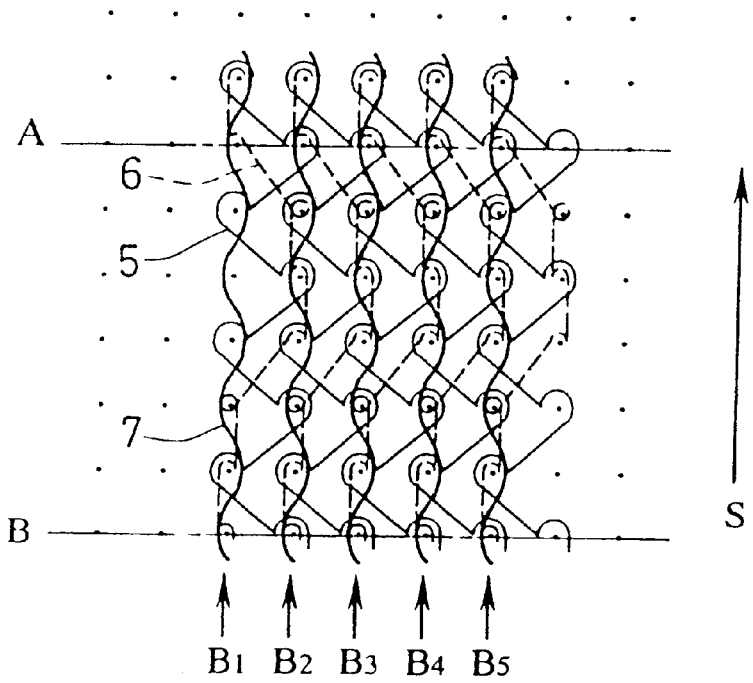
Fig. 11 (b)

Fig. 12 (a)
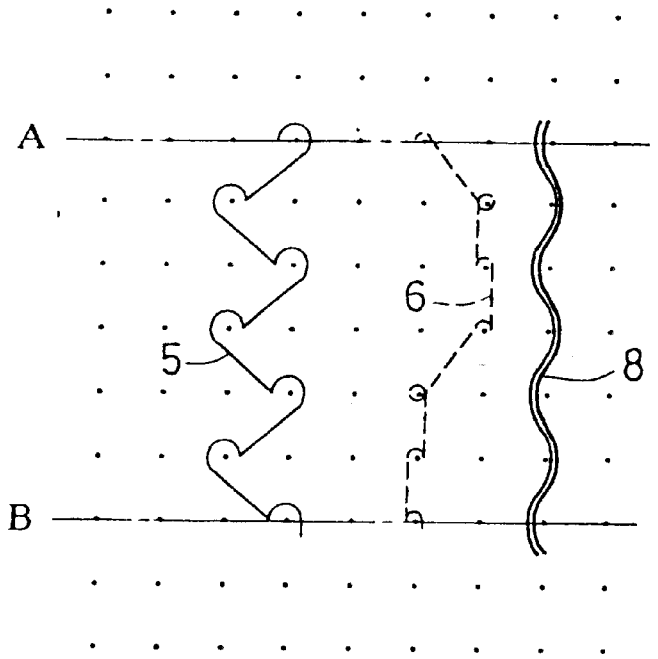
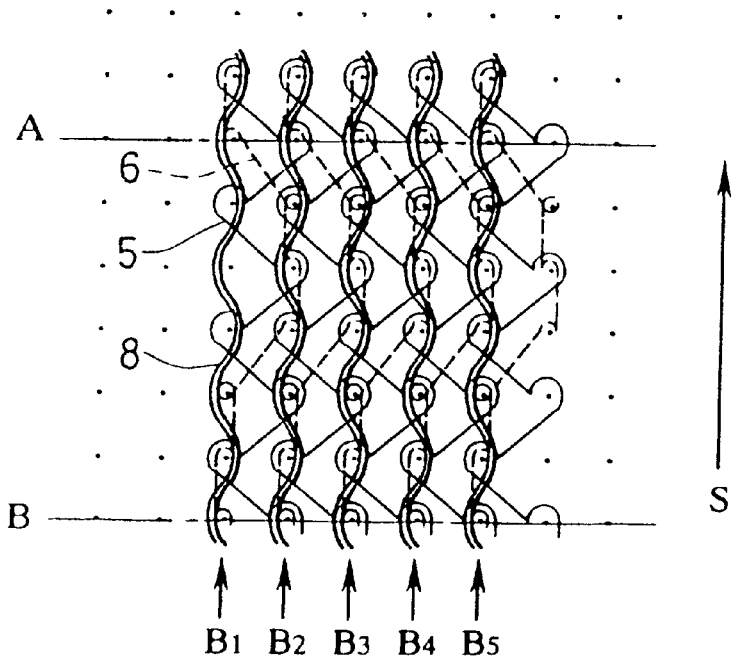
Fig. 12 (b)

Fig. 13 (a)
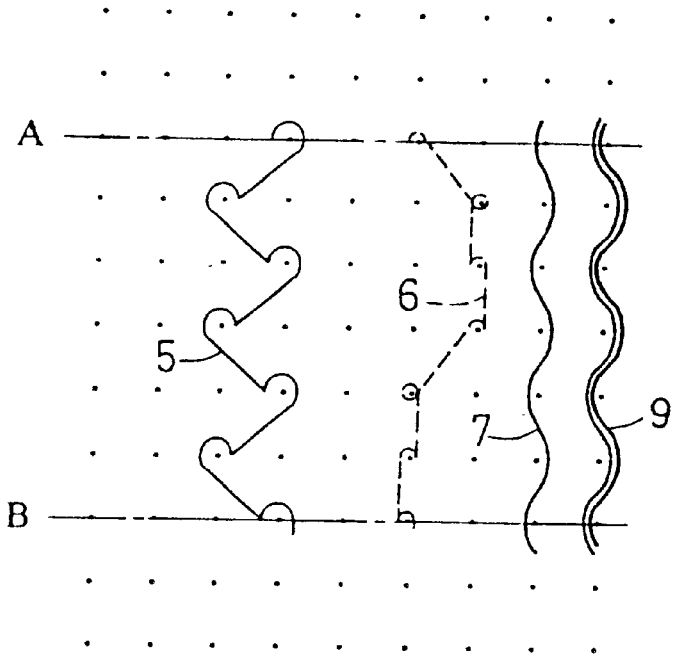
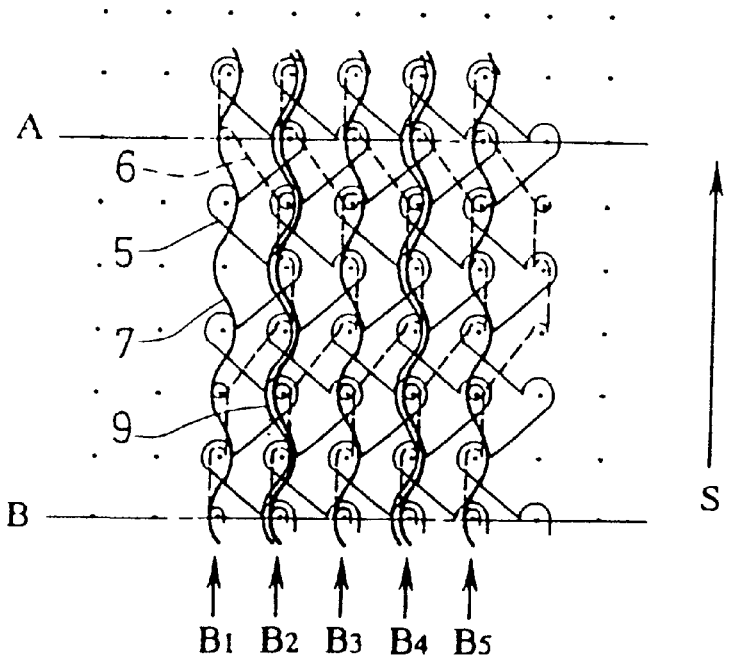
Fig. 13 (b)

Fig. 14 (a)
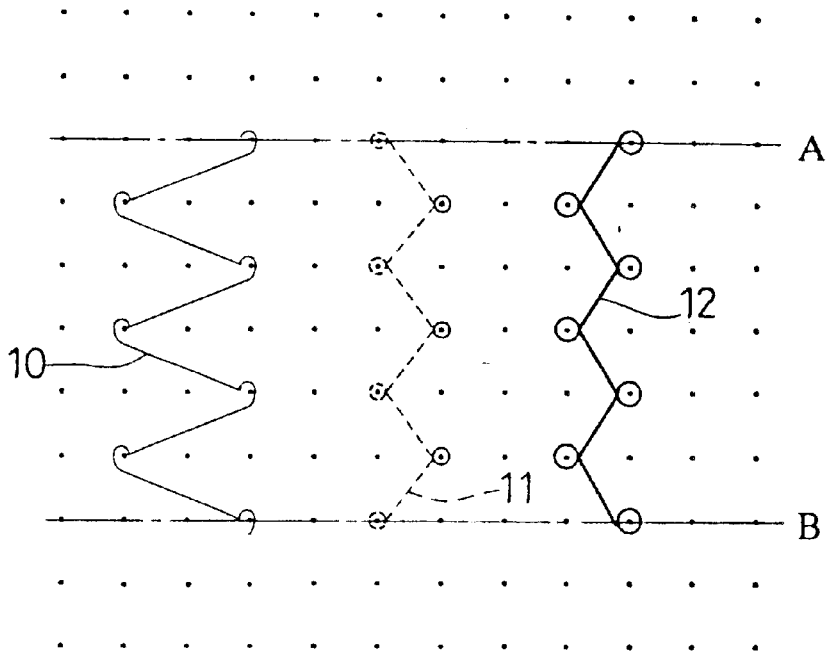
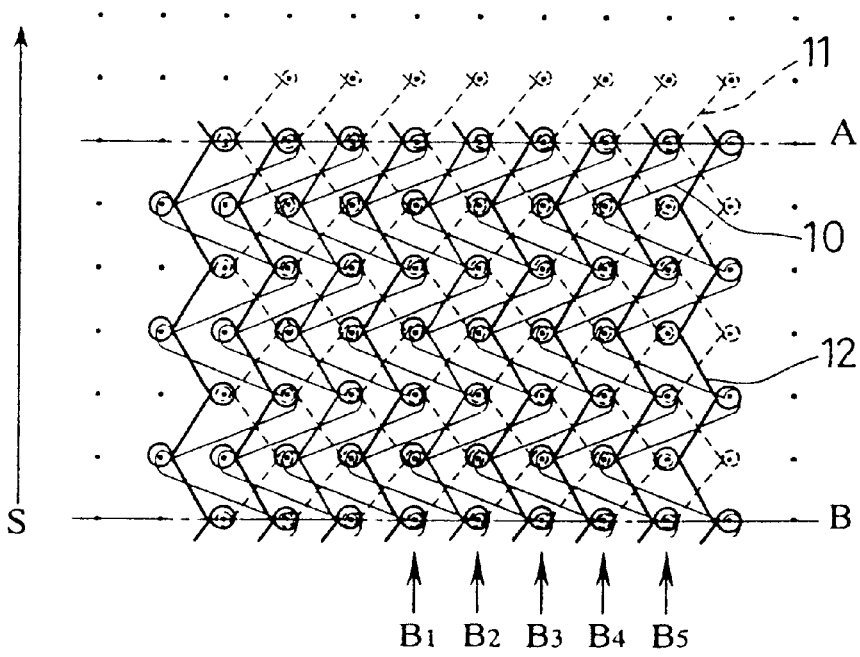
Fig. 14 (b)

GARMENT WITH FIGURE CONTROL OR MUSCLE SUPPORT FUNCTION

INDUSTRIAL FIELD

The present invention relates to a garment with a figure control or muscle support function comprising a warp knit fabric partially having portions with strong and weak straining forces. Particularly, this invention relates to a garment with a figure control or muscle support function comprising a warp knit fabric, in which the ground stitch is changed at a boundary between the portions with strong and weak straining forces so that substantially no difference in level is developed at the boundary.

BACKGROUND OF THE INVENTION

Conventionally, in order to provide a figure control or muscle support function to a garment such as girdle, short panty, body suit, swim suit, leotard, brassiere, spats, sports tights, and the like, most commonly used is a method of attaching appropriate strengthened pieces to portions on either back or face side of the fabric of the garment main part, which are desired to have large straining forces.

Such a conventional method will be described using a long type girdle as a representative example. FIG. 29 is a perspective view from the front side of a conventional long type girdle, and FIG. 30 is a perspective view from the back side thereof.

In FIGS. 29 and 30, numeral 181 denotes a strengthened piece for controlling the hip shape and keeping an upward profile for the hip and buttock line, which extends from beneath the bulge of the hips through the outer side of the bulge to the side abdomen. The strengthened piece is normally attached and sewn to the back side of the main body fabric of the girdle. The numeral 182 indicates an abdomen-press cloth piece attached to a center portion of the abdomen part, and is attached and sewn to either face or back side of the main body fabric of the girdle. The abdomen-press cloth piece 182 prevents swelling of superfluous flesh of the abdomen to achieve a fine line of the abdomen. Furthermore, numeral 183 indicates a strengthened piece for firmly holding a wearer's thighs to prevent sliding-up of the girdle leg parts as well as to achieve a fine leg line of the wearer, which is a relatively wide elastic tape-like material attached and sewn to the back side of the hem of the long type girdle.

Also, it has been proposed that a similar figure control function may be provided without using strengthened pieces, by applying an elastic synthetic resin solution to certain portions which could be provided with strengthened pieces to increase the straining force of the portions.

Furthermore, in recent years, it has also been proposed that a similar figure control function may be provided by using a circular knitting machine, without using strengthened pieces, by changing the stitch of the circular knitting so as to increase the straining forces of the portions which could be provided with strengthened pieces.

Having described a long type girdle as a representative example, a garment in which straining forces in predetermined portions are increased to provide a figure control or muscle support function is also widely applied to other types of garments, such as short type girdle (girdles include long or short type girdles for pregnant women), short panty, body suit, swim suit, leotard, brassiere, spats, sports tights, and the like. Recently in sports, what is called taping is performed to reduce or prevent muscle fatigue etc., and thus preventing disorder caused by accumulation of muscle fatigue, or to protect damaged muscles. However, there is a problem that only experts can perform such taping. Therefore, in these days, attention has been given to sports tights, which are provided with a function to reduce or prevent muscle fatigue or to prevent muscle disorder without inhibiting muscle movement capability, by having portions with large straining forces that correspond to parts of both sides of predetermined muscles, for example, leg muscles such as regio femoris anterior muscle group comprising musculus vastus lateralis, musculus rectus femoris, and musculus vastus medialis, musculus gastrocnemius, musculus soleus, and the like (avoiding muscle belly and providing portions with large straining forces on both sides of these muscles or muscle group along the direction of muscle fibers), or by providing portions with large straining forces on one or both sides of the muscles of regio femoris posterior muscle group (comprising musculus biceps femoris, musculus semitendinosus and musculus semimembranosus), which is called hamstrings. Hereinafter, a garment for sports use having portions with large straining forces for the above-mentioned objects will be referred to as "a garment with a muscle support function" for simplification. Such a garment with a muscle support function may also be provided with portions having large straining forces according to the same method as described above for girdles.

However, a garment using strengthened pieces for portions with large straining forces develop differences in level due to the different thickness at the boundaries between the portions with the strengthened pieces and those without them. Thus, the differences in level are reflected in an outer wear and are seen from outside thereof, so that a wearer's appearance is degraded significantly. Moreover, because the strengthened pieces are sewn to the main part of the garment, increased thickness of the sewn parts may deteriorate skin touch, or cause skin disease (skin damage).

In the method of providing increased straining force by applying an elastic synthetic resin solution, because knitted loops are filled with the synthetic resin, breathability is drastically reduced, and stuffiness is developed easily. In addition, because the synthetic resin coating directly contacts the skin, wearing comfort may also be reduced.

Moreover, a garment which is provided with a figure control function by using a circular knitting machine, without using strengthened pieces, in which the stitch of the circular knitting is changed so as to increase the straining force of the portions which could be provided with strengthened pieces, lacks stability in the stitch due to the change of the straining force. Therefore, even if garments are produced by the same circular knitting machine using the same fiber material, and are designed in the same dimensions, the finished dimensions of the garments have considerably large disparity. Moreover, because a circular knit product easily develops a so-called "run", there are problems in durability as well as poor productivity in mass production. Moreover, gauge of circular knitting cannot be made as high as that of warp knitting.

The present invention was accomplished in order to solve the above-mentioned problems. Thus, it is an object of the present invention to provide a garment which has substantially no difference in level at a boundary between portions with strong and weak straining forces, is free of a problem in which a difference in level is reflected in an outer wear and is seen from outside thereof, is comfortable to wear, keeps a fine appearance of a wearer, and has a required figure control or muscle support function. Furthermore, it is another object of the present invention to provide a garment with a figure control or muscle support function, in which breathability is not reduced, stuffiness is difficult to develop, and skin touch is not deteriorated, compared with a garment coated with a synthetic resin solution to have a straining force. It is still another object of the present invention to provide a garment with a figure control or muscle support function, in which finished dimensions are stable, products with the same finished dimensions are easily manufactured on a large scale, durability is good, high gauge can be achieved, and productivity is excellent, compared with a circular knit product.

SUMMARY OF THE INVENTION

In order to solve the above-mentioned problems, the present invention provides a garment with a figure control or muscle support function as follows:

(1) A garment comprising:

a warp knit fabric;

said warp knit fabric having ground stitches by jacquard knitting;

said warp knit fabric including substantially inelastic yarn;

at least one elastic yarn is one of inserted and knitted in said warp knit fabric;

said garment including at least first and second portions forming predetermined patterns;

said first portion having a relatively strong straining force and said second portion having a relatively weak straining force;

said strong and said weak straining forces being produced by differences in stitches appearing on a face side of said ground stitches;

at least one of said predetermined patterns is a band-shaped and curved continuous pattern.

(2) A garment comprising:

a warp knit fabric having ground stitches by jacquard knitting;

said warp knit fabric being an inelastic yarn;

at least one elastic yarn inserted in said warp knit fabric;

said ground stitches having at least first and second strengths of straining forces;

said first and second strengths being formed by differences in stitches appearing on a face side of said ground stitches;

said first and second strengths forming predetermined patterns related to a figure control or muscle support function for a wearer of said garment;

at least one of said predetermined patterns is a band-shaped and curved continuous pattern.

(3) A garment according to the item (1) or (2), wherein at least one of a number and a thickness of said elastic yarn is changed to produce said strong and said weak straining forces.

(4) A garment according to the item (1) or (2), wherein at least one of a number and a thickness of said elastic yarn is changed to produce said first and second strengths of straining forces.

(5) A garment according to the item (1) or (2), wherein the stitches appearing on a face side of said ground stitches by jacquard knitting include a combination of satin type net and mesh type net stitches.

(6) A garment according to the item (1) or (2), wherein said first portion includes a satin type net stitch and said second portion includes a mesh type net stitch in the stitches appearing on a face side of said ground stitches by jacquard knitting.

(7) A garment according to the item (1), wherein the stitches appearing on a face side of said ground stitches by jacquard knitting include a combination of satin type tricot and mesh type tricot stitches.

(8) A garment according to the item (1), wherein said first portion includes a satin type tricot stitch and said second portion includes a mesh type tricot stitch in the stitches appearing on a face side of said ground stitches by jacquard knitting.

(9) A garment according to the item (1) or (2), wherein said at least one elastic yarn in said first portion includes at least two elastic yarns and said at least one elastic yarn in said second portion includes a number of elastic yarns that is less than in said first portion.

(10) A garment according to the item (1) or (2), further comprising: a third portion;

said third portion having a straining force that is greater than said first portion; and said third portion including a satin type net stitch having a substantial portion including a racking of at least two needles in the stitches appearing on a face side of said ground stitches by jacquard knitting.

(11) A garment according to the item (1), further comprising:

a third portion;

said third portion having a straining force that is greater than said first portion; and said third portion including a satin type tricot stitch having a substantial portion including a racking of at least three needles in the stitches appearing on a face side of said ground stitches by jacquard knitting.

(12) A garment according to the item (1) or (2), wherein said first portion includes said band-shaped and curved continuous pattern.

(13) A garment according to the item (11), wherein said third portion includes said band-shaped and curved continuous pattern.

(14) A garment according to the item (1) or (2), wherein said ground stitches by jacquard knitting include nylon yarn of 20 to 80 denier.

(15) A garment according to the item (1) or (2), wherein said elastic yarn is polyurethane fiber yarn of 40 to 560 denier.

(16) A garment according to the item (1) or (2), wherein said garment is one of a girdle, a short panty, a body suit, a swim suit, a leotard, a brassiere, spats, and sports tights.

(17) A garment according to the item (1) or (2), further comprising small patterns formed by knitting stitches.

(18) A garment according to the item (1) or (2), wherein:

said garment has a hip region; and said band-shaped and curved continuous pattern is included in said first portion and is a part of said garment that in use covers from beneath a bulge of right and left hips to sides of a wearer's body.

(19) A garment according to the item (1) or (2), wherein:

said garment is a girdle;

said band-shaped and curved continuous pattern is included in said first portion with a relatively strong straining force and is a part of said girdle that in use covers from beneath a bulge of right and left hips to sides of a wearer's body.

(20) A garment according to the item (19), wherein:

said garment is a girdle; and said first portion comprises a part of said girdle that in use covers approximately a center of an abdomen of a wearer's body.

(21) A garment according to the item (1) or (2), wherein:

said garment is a brassiere; and said band-shaped and curved continuous pattern is included in said first portion and is a part of said brassiere extending from a lower region to a side of a breast cup.

(22) A garment according to the item (21), wherein:

said garment is a brassiere; and said first portion comprises a part of a back cloth piece of said brassiere that in use corresponds to sides of a wearer's body.

BRIEF DESCRIPTION OF THE DRAWINGS

FIGS. 12(*a*) and 12(*b*) are schematic stitch representations for explaining a condition in which elastic yarn is inserted in a ground stitch.

FIGS. 13(*a*) and 13(*b*) are schematic stitch representations for explaining a condition in which elastic yarn is inserted in a ground stitch.

FIGS. 14(*a*) and 14(*b*) are schematic stitch representations for explaining a condition in which elastic yarn is knitted in a satin type tricot ground stitch.

DETAILED DESCRIPTION OF THE INVENTION

A warp knit fabric is used in a garment of the present invention. Although not particularly limiting, the warp knit fabric is generally designed So that the knitting direction, i.e. the direction in which yarn is provided, may become approximately the lateral direction of the finished garment. However, depending on the kind of the garment or a part of the garment to be applied, the knitting direction may also be an oblique direction.

The warp knit fabric used in the present invention is actually knitted by using a warp knitting machine having a jacquard control mechanism etc. (for example, see U.S. Pat. No. 5,390,512 (corresponding to Japanese Published Unexamined Patent Application (Tokkai) No. Hei 6-166934)), providing inelastic yarn for ground stitches and elastic yarn to be inserted and/or knitted, which are simultaneously knitted on the warp knitting machine. First, the ground stitch will be explained below for easy understanding.

In the present invention, portions with relatively strong and weak straining forces are formed in predetermined places in predetermined patterns by changing the ground stitches depending on the required strength of the straining forces. The following example explains a simple case of producing a body fabric for the back to the side of a girdle, in which a portion with a relatively strong straining force which corresponds to a part of the girdle that in use covers from beneath the bulge of the right and left hips to the sides of a wearer's body, and other portions with relatively weak straining forces, are formed in patterns in the fabric.

Figure 1:
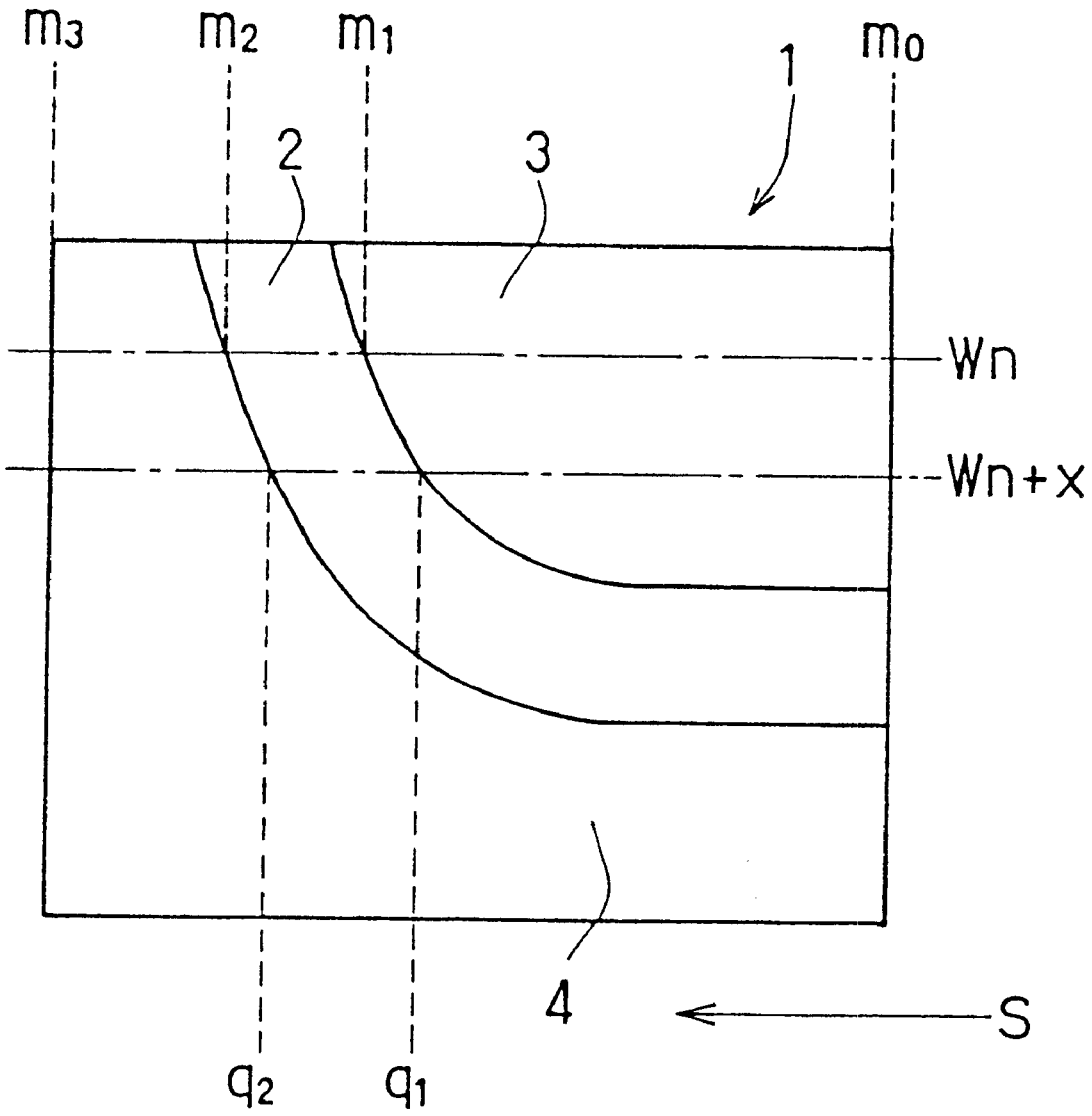
FIG. 1 is a plan view of one embodiment of a left body fabric for the back to the side of a girdle used in the present invention.

FIG. 1 shows a plan view of a left body fabric 1 for the back to the side of a girdle as described above. It is herein supposed that a fabric having patterns of portions with strong and weak straining forces is produced, in which a portion 2 has a relatively strong straining force, a portion 3 for covering the left hip has a relatively weak straining force, and a portion 4 for covering the left leg and side has a relatively weak straining force. An arrow S indicates a direction in which yarn is provided to form the warp knit fabric. That is, the arrow S indicates the direction in which the fabric is released from a warp knitting machine when knitted thereby.

If the ground stitch of the portion 2 with a relatively strong straining force is a satin type net stitch, and those of the portions 3 and 4 with relatively weak straining forces are a mesh type net stitch, a fabric having these ground stitches is produced, for example, by the method as follows: When wale $W_n$ in FIG. 1 is knitted by a warp knitting machine having a jacquard control mechanism etc. (for example, see U.S. Pat. No. 5,390,512 (corresponding to Japanese Published Unexamined Patent Application (Tokkai) No. Hei 6-166934), or particularly, a high speed jacquard raschel machine "RSJ 4/1" including deflecting transducers attached to yarn guide bars, manufactured by Karl Mayer Textilmaschinenfabric GmbH (marketed by Japan Mayer Ltd.)), courses $m_0$ to $m_1$ are knitted with a mesh type net stitch, courses $m_1$ to $m_2$ are knitted with a satin type net stitch, and courses $m_2$ to $m_3$ are knitted with a mesh type net stitch. In the same way, when wale $W_{n+x}$ shown in FIG. 1 is knitted, courses $m_0$ to $q_1$ are knitted with a mesh type net stitch, courses $q_1$ to $q_2$ are knitted with a satin type net stitch, and courses $q_2$ to $m_3$ are knitted with a mesh type net stitch. Such a knitting can be accomplished by entering instructions for each wale and course as mentioned above in a computer of the above-mentioned warp knitting machine having a jacquard control mechanism.

Furthermore, for example, when it is desired that straining forces in the portions with relatively strong straining forces have two or more grades, it may be achieved with ground stitches according to the following method.

Figure 2:
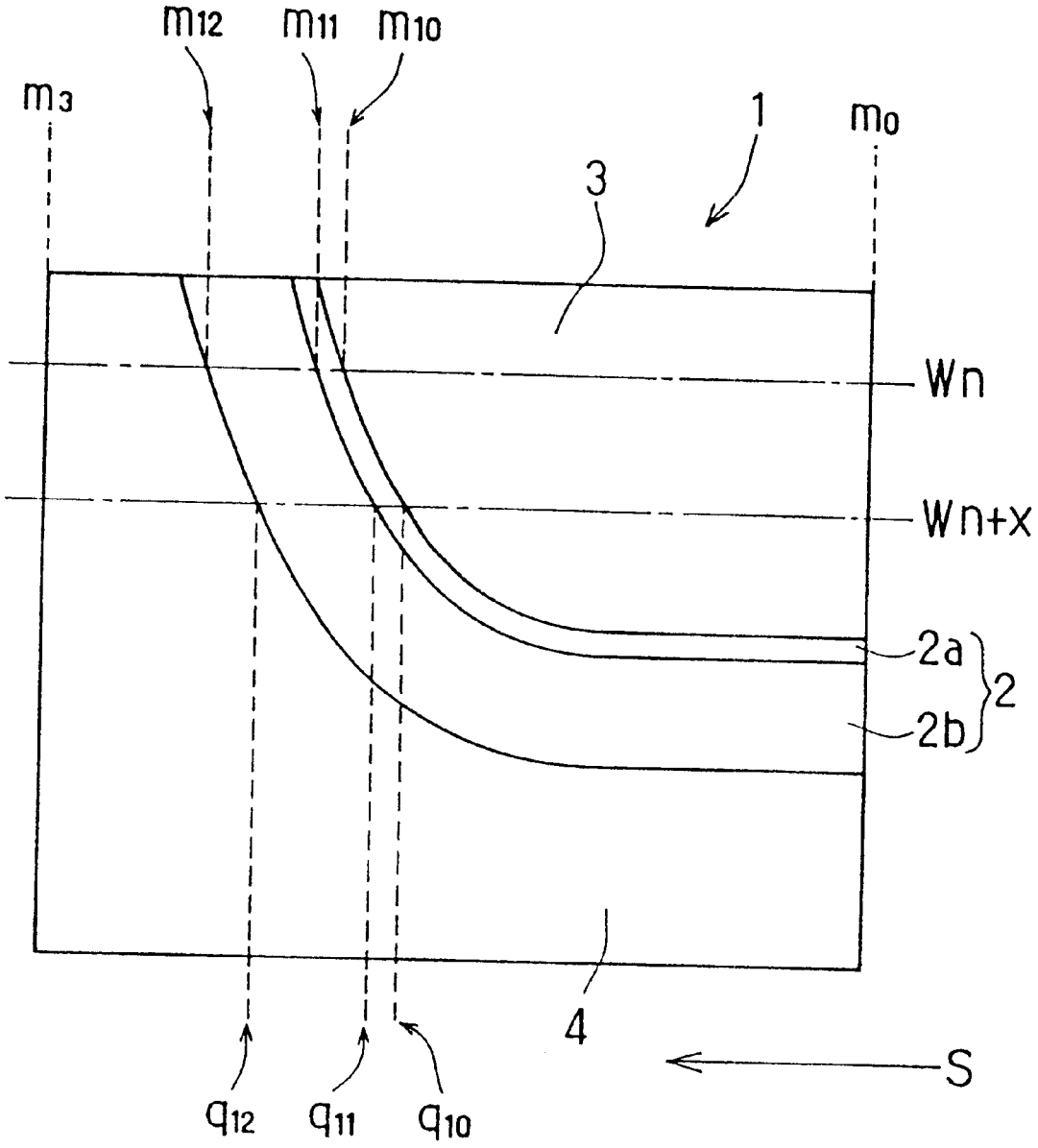
FIG. 2 is a plan view of another embodiment of a left body fabric for the back to the side of a girdle used in the present invention.

FIG. 2 shows a plan view of a left body fabric 1 for the back to the side of a girdle, which is similar to the view shown in FIG. 1. In this drawing, a portion 2 has a relatively strong straining force, a portion 3 for covering the left hip has a relatively weak straining force, and a portion 4 for covering the left leg and side has a relatively weak straining force. What is different from FIG. 1 is that the portion 2 comprises a portion 2*a* having a relatively strong straining force and a portion 2*b* having a stronger straining force than the portion 2*a*.

An arrow S indicates the direction in which yarn is provided to form a warp knit fabric having these patterns of the portions with weak straining forces and portions with strong straining forces of two grades. That is, the arrow S indicates the direction in which the fabric is released from a wrap knitting machine when knitted thereby.

If the ground stitch of the portions 2 (2*a* and 2*b*) with relatively strong straining forces is a satin type net stitch, and those of the portions 3 and 4 with relatively weak straining forces are a mesh type net stitch, a fabric having these ground stitches is produced, for example, by the method as follows. Furthermore, the same warp knitting machine having a jacquard control mechanism as mentioned above or the like (for example, see U.S. Pat. No. 5,390,512 (corresponding to Japanese Published Unexamined Patent Application (Tokkai) No. Hei 6-166934), or particularly, a high speed jacquard raschel machine "RSJ 4/1" including deflecting transducers attached to guide bars, manufactured by Karl Mayer Textilmaschinenfabric GmbH) may be used. To avoid overlapping, explanation of the method for forming the portions 3 and 4 with relatively weak straining forces is omitted, because it is the same as described above for FIG. 1. Therefore, omitting to explain the portions 3 and 4, and drawing attention only to the portions 2*a* and 2*b*, an example of a method of forming the portion 2*a* with a relatively strong straining force and the portion 2*b* with a stronger straining force than the portion 2*a* in desired patterns will be mainly described with reference to FIG. 2.

When wale $W_n$ in FIG. 2 is knitted, courses $m_{10}$ to $mi_{11}$ are knitted with a satin type net stitch having a racking of two or more needles in relatively small proportion, and courses $m_{11}$ to $m_{12}$ are knitted with a satin type net stitch having a racking of two or more needles in large proportion. In the same way, when wale $W_{n+X}$ in FIG. 2 is knitted, courses $q_{10}$ to $q_{11}$ are knitted with a satin type net stitch having a racking of two or more needles in relatively small proportion, and courses $q_{11}$ to $q_{12}$ are knitted with a satin type net stitch having a racking of two or more needles in large proportion. Such a knitting can be achieved by entering instructions for each wale and course as mentioned above in a computer of the above-mentioned warp knitting machine having a jacquard control mechanism.

It has been substantially difficult to knit such a portion with a relatively strong straining force as mentioned above in a band-shaped and curved continuous pattern by warp knitting, when a conventional old warp knitting machine is used. However, as is clear from the above description, by using the above-mentioned method, the ground stitches can be easily changed without limitation in the width or length direction. Furthermore, the straining forces can also be relatively freely changed without limitation in the width or length direction. It has been difficult to realize a curved continuous pattern using a conventional old warp knitting machine, and substantially only a linear continuous band-shaped pattern parallel to the length direction has been possible.

Figure 3:
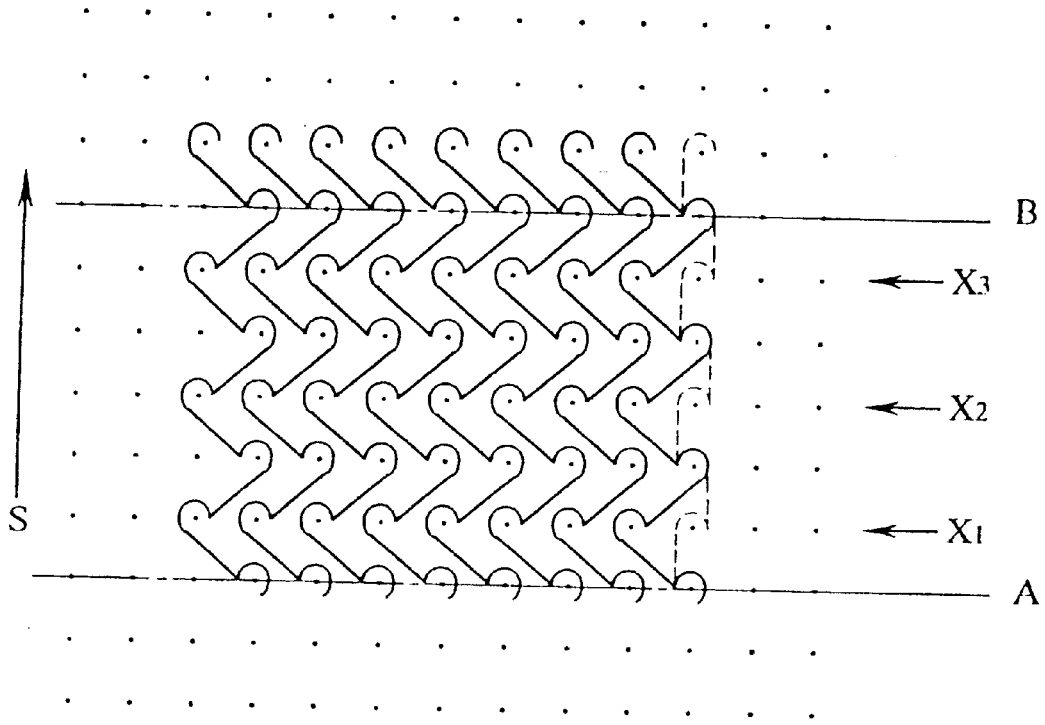
FIG. 3 is a schematic stitch representation of one embodiment of a satin type net stitch used in the present invention.
Figure 4:
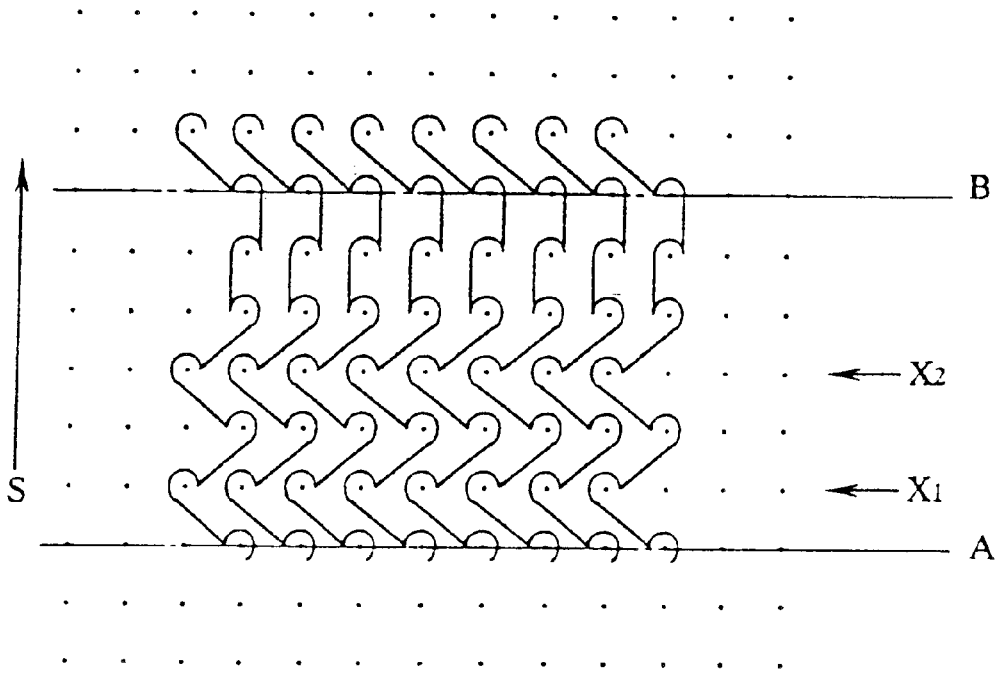
FIG. 4 is a schematic stitch representation of another embodiment of a satin type net stitch used in the present invention.
Figure 5:
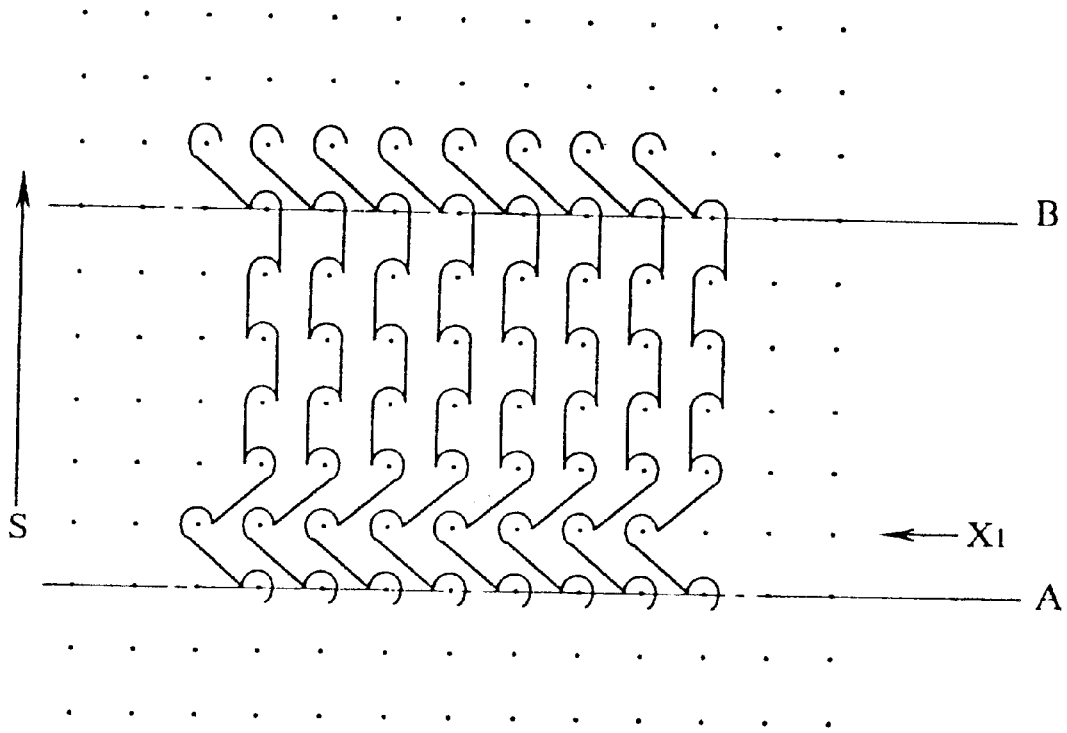
FIG. 5 is a schematic stitch representation of still another embodiment of a satin type net stitch used in the present invention.

FIGS. 3 to 5 are schematic stitch representations of the face side of satin type net stitches used in the present invention. These diagrams are illustrated in accordance with the rules commonly used in the knitting industry. Therefore, although these diagrams do not faithfully illustrate the actual conditions of yarn in the knitting stitches, they are generally used by those skilled in the art.

In any of these drawings, an arrow S indicates the direction of the arrow S shown in FIG. 2. That is, the arrow S indicates the direction in which yarn is provided to form a satin type net (warp knit fabric). The satin type net stitches shown in FIGS. 3 to 5 are only some examples, and other kinds of satin type net stitches may also be employed in the present invention.

FIG. 3 shows a satin type net stitch having a racking of two needles in the courses indicated by arrows $X_1$, $X_2$, and $X_3$ for jacquard movement, as shown by each arrow toward the left in the drawing. The stitch shown by a dotted line at the right end in FIG. 3 is a hypothetical stitch without a racking of two needles, which is shown for reference. Furthermore, the portion between alternate long and short dash lines A and B is one repeat unit in FIG. 3, and at least six courses are illustrated as one repeat unit for easy understanding.

The tension of yarn is increased in a portion with a racking of two needles. Therefore, the larger the proportion of a racking of two needles in one repeat unit, the stronger the straining force. The satin type net stitch shown in FIG. 3 has a racking of two or more needles in three courses $X_1$, $X_2$, and $X_3$ in one repeat unit, and has the strongest straining force compared with the satin type net stitches shown in FIGS. 4 and 5 as described below.

FIG. 4 shows a satin type net stitch having a racking of two needles in the courses indicated by arrows $X_1$ and $X_2$ for jacquard movement, as shown by each arrow toward the left in the drawing. Furthermore, the portion between alternate long and short dash lines A and B is one repeat unit in FIG. 4. The satin type net stitch shown in FIG. 4 has a racking of two or more needles in two courses $X_1$ and $X_2$ in one repeat unit, and has a weaker straining force than the above-mentioned satin type net stitch shown in FIG. 3. However, it has a stronger straining force than the satin type net stitch shown in FIG. 5 as described below.

FIG. 5 shows a satin type net stitch having a racking of two needles in a course indicated by an arrow $X_1$ for jacquard movement, as indicated by the arrow toward the left in the drawing. Furthermore, the portion between alternate long and short dash lines A and B is one repeat unit in FIG. 5. The satin type net stitch shown in FIG. 5 has a racking of two or more needles in only one course $X_1$ in one repeat unit, and thus has a weaker straining force than the above-mentioned satin type net stitches shown in FIGS. 3 and 4. However, it has a stronger straining force than the mesh type net stitch in FIG. 6 as described below.

Figure 6:
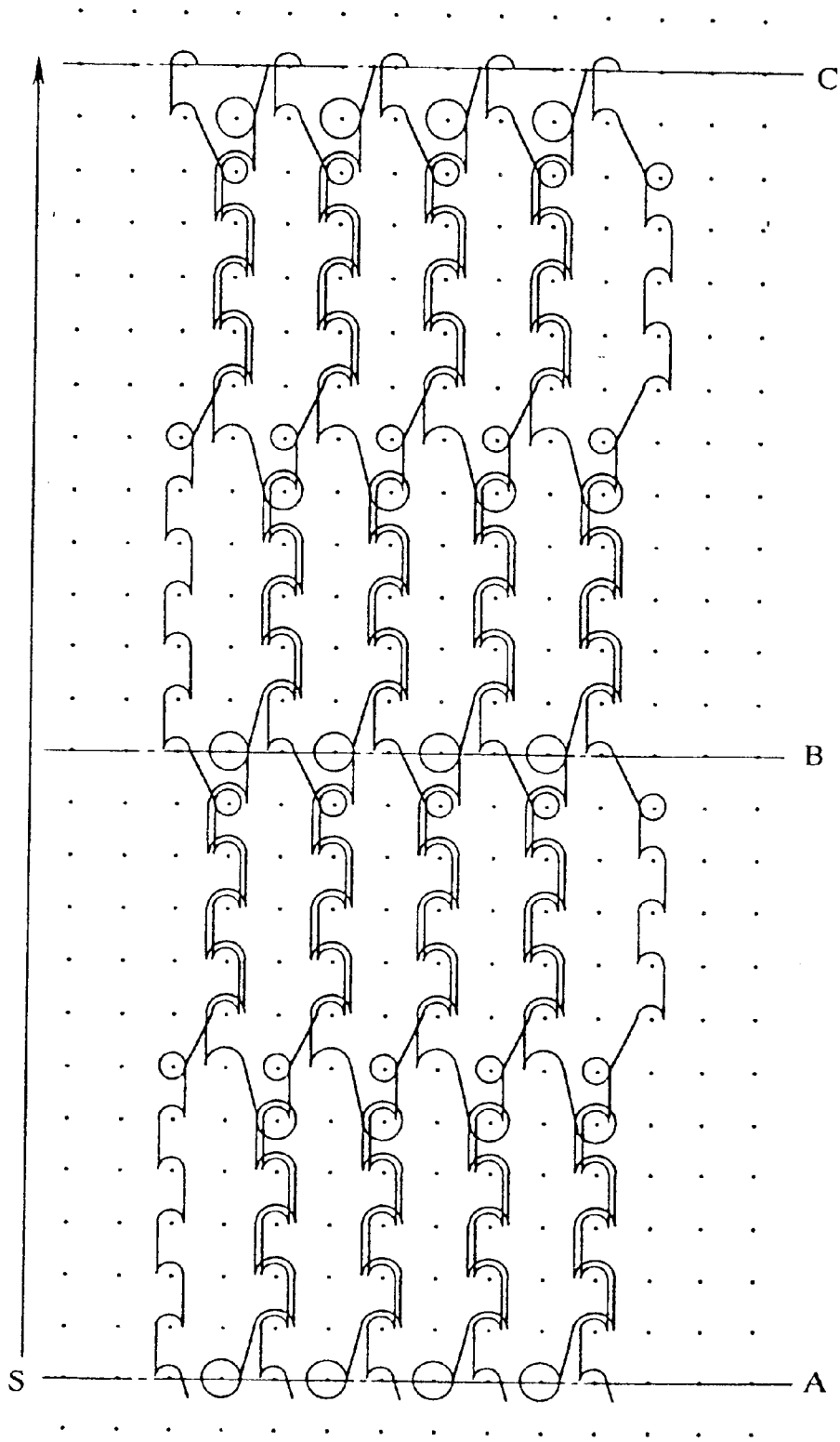
FIG. 6 is a schematic stitch representation of a mesh type net stitch used in the present invention.

FIG. 6 is a schematic stitch representation of the face side of a mesh type net stitch used in the present invention.

In FIG. 6, an arrow S indicates the direction of the arrow S in FIG. 2. That is, the arrow S indicates a direction in which yarn is provided to form a mesh type net stitch (warp knit fabric). The mesh type net stitch shown in FIG. 6 is only one example, and other kinds of mesh type net stitches may also be employed in the present invention.

As is also clear from FIG. 6, a mesh type net stitch has larger proportion of spaces and lower density of yarn per unit area than a satin type net stitch, and thus has a weaker straining force than the above-mentioned satin type net stitch in FIGS. 3 to 5. Moreover, in FIG. 6, the portion between alternate long and short dash lines A and B and the portion between alternate long and short dash lines B and C are respectively one repeat unit. That is, the stitch between A and B and the stitch between B and C are the same repeated stitch.

By controlling the ground stitches according to the above-mentioned embodiment, portions with relatively strong and weak straining forces can be formed in predetermined places in predetermined patterns. In general, a satin type net stitch is used for a portion with a relatively strong straining force, and a mesh type net stitch is used for a portion with a relatively weak straining force.

Furthermore, when the portion with a relatively strong straining force is separated into patterns of portions having different straining forces of two grades, as illustrated in FIG. 2, for example, any two from the satin type net stitches shown in FIGS. 3 to 5 may be used in combination. Furthermore, when patterns of portions with strong straining forces of three or more grades are formed, for example, stitches shown in FIGS. 3, 4 or 5, or the like may be used in combination. Moreover, the embodiments shown in FIGS. 3 to 5 are just some representative examples, and the present invention is not limited only to these examples.

Furthermore, a knitting stitch with a racking of two needles, etc., as described above with reference to FIGS. 3 to 5, can be achieved by electrically controlling yarn guide bars to which deflecting transducers using piezo elements etc. are attached, and are provided in a warp knitting machine having a jacquard control mechanism. This method is described in detail, for example, in the above-mentioned U.S. Pat. No. 5,390,512 (corresponding to Japanese Published Unexamined Patent Application (Tokkai) No. Hei 6-166934), and particularly, a high speed jacquard raschel machine "RSJ 4/1" manufactured by Karl Mayer Textilmaschinenfabric GmbH may be used.

Having described cases of net stitches by jacquard knitting (warp knitting) used as ground stitches, the following describes cases of tricot stitches by jacquard knitting (warp knitting) used as ground stitches.

Also referring to the plan view of the left body fabric 1 for the back to the side of a girdle in FIGS. 1 or 2 as an example, the case of tricot stitches will be described below. The arrow S also indicates a direction in which yarn is provided to form the warp knit tricot fabric by jacquard knitting. That is, the arrow S indicates the direction in which the fabric is released from a wrap knitting machine when knitted thereby.

If the ground stitch of the portion 2 with a relatively strong straining force is a satin type tricot stitch, and those of the portions 3 and 4 with relatively weak straining forces are mesh type tricot stitches, a fabric having these ground stitches is produced, for example, by the method as follow: When wale $W_n$ in FIG. 1 is knitted by a warp knitting machine having a jacquard control mechanism (for example, see U.S. Pat. No. 5,390,512 (corresponding to Japanese Published Unexamined Patent Application (Tokkai) No. Hei 6-166934), or particularly, a high speed jacquard raschel machine "RSJ 4/1" including deflecting transducers attached to yarn guide bars, manufactured by Karl Mayer Textilmaschinenfabric GmbH (marketed by Japan Mayer Ltd.)), courses $m_0$ to $m_1$ are knitted with a mesh type tricot stitch, courses $m_1$ to $m_2$ are knitted with a satin type tricot stitch, and courses $m_2$ to $m_3$ are knitted with a mesh type tricot stitch. In the same way, when wale $W_{n+X}$ in FIG. 1 is knitted, courses $m_0$ to $q_1$ are knitted with a mesh type tricot stitch, courses $q_1$ to $q_2$ are knitted with a satin type tricot stitch, and courses $q_2$ to $m_3$ are knitted with a mesh type tricot stitch. Such a knitting can be achieved by entering instructions for each wale and course as mentioned above in a computer of the above-mentioned warp knitting machine having a jacquard control mechanism.

Furthermore, for example, when it is desired that the straining force in the portion with a relatively strong straining force has two or more grades, it can be achieved with ground tricot stitches by the following method.

Referring to FIG. 2 mentioned above, a portion 2 has a relatively strong straining force, a portion 3 for covering the left hip has a relatively weak straining force, and a portion 4 for covering the left leg and side has a relatively weak straining force. What is different from FIG. 1 is that the portion 2 with a relatively strong straining force comprises a portion 2*a* with a relatively strong straining force and a portion 2*b* with a stronger straining force than the portion 2*a*.

The arrow S indicates the direction in which yarn is provided to form a warp knit fabric having these patterns of the portions with a weak straining force and portions with strong straining forces of two grades. That is, the arrow S indicates the direction in which the fabric is released from a wrap knitting machine when knitted thereby.

If the ground stitches of the portions 2 (2*a* and 2*b*) with relatively strong straining forces are satin type tricot stitches, and those of the portions 3 and 4 with relatively weak straining forces are mesh type tricot stitches, a fabric having these ground stitches is produced, for example, by the method as follows. Furthermore, the same warp knitting machine having a jacquard control mechanism as mentioned above (for example, see U.S. Pat. No. 5,390,512 (corresponding to Japanese Published Unexamined Patent Application (Tokkai) No. Hei 6-166934), or particularly, a high speed jacquard raschel machine "RSJ 4/1" including deflecting transducers attached to guide bars, manufactured by Karl Mayer Textilmaschinenfabric GmbH) may be used. Furthermore, to avoid overlapping, explanation for the method of forming portions 3 and 4 with relatively weak straining forces is omitted, because it is the same as that described above for tricot stitches with reference to FIG. 1. Therefore, omitting to explain the portions 3 and 4 and drawing attention only to the portions 2*a* and 2*b*, an example of a method for forming the portion 2*a* with a relatively strong straining force and the portion 2*b* with a stronger straining force than the portion 2*a* in desired patterns will be mainly described with reference to FIG. 2.

When wale $W_n$ in FIG. 2 is knitted, courses $m_{10}$ to $m_{11}$, are knitted with a satin type tricot stitch having a racking of two or three or more needles in relatively small proportion, and courses $m_{11}$, to $m_{12}$ are knitted with a satin type tricot stitch having a racking of two or three or more needles in large proportion. In the same way, when wale $W_{n+X}$ in FIG. 2 is knitted, courses $q_{10}$ to $q_{11}$ are knitted with a satin type tricot stitch having a racking of two or three or more needles in relatively small proportion, and courses $q_{11}$ to $q_{12}$ are knitted with a satin type tricot stitch having a racking of two or three or more needles in large proportion. Such a knitting can be achieved by entering instructions for each wale and course as mentioned above in a computer of the above-mentioned warp knitting machine having a jacquard control mechanism.

Figure 7:
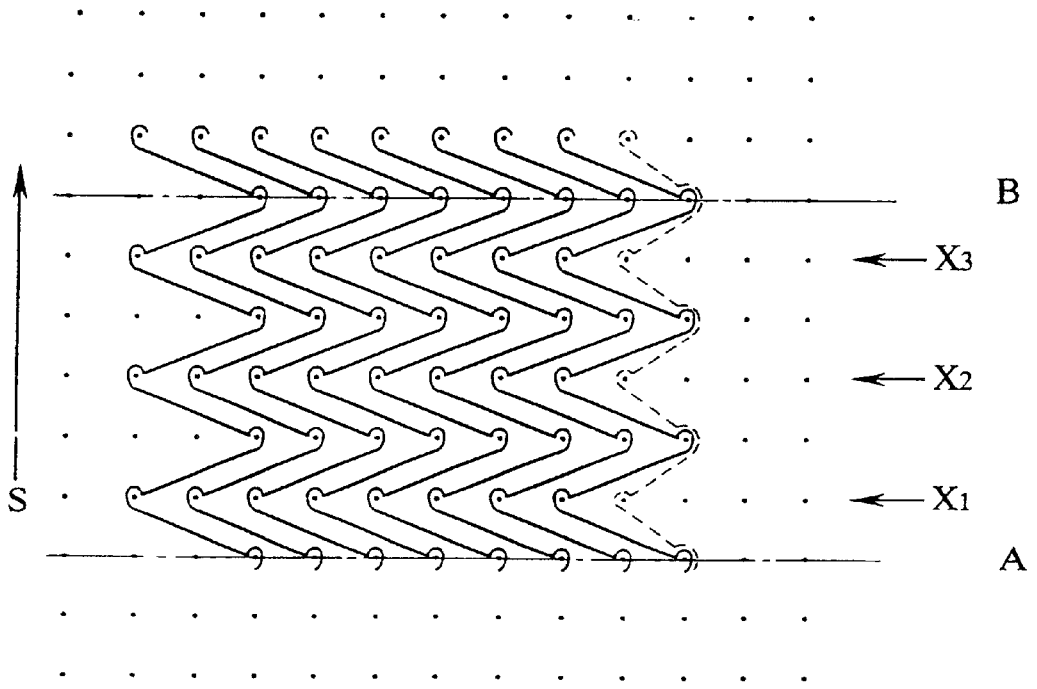
FIG. 7 is a schematic stitch representation of one embodiment of a satin type tricot stitch used in the present invention.
Figure 8:
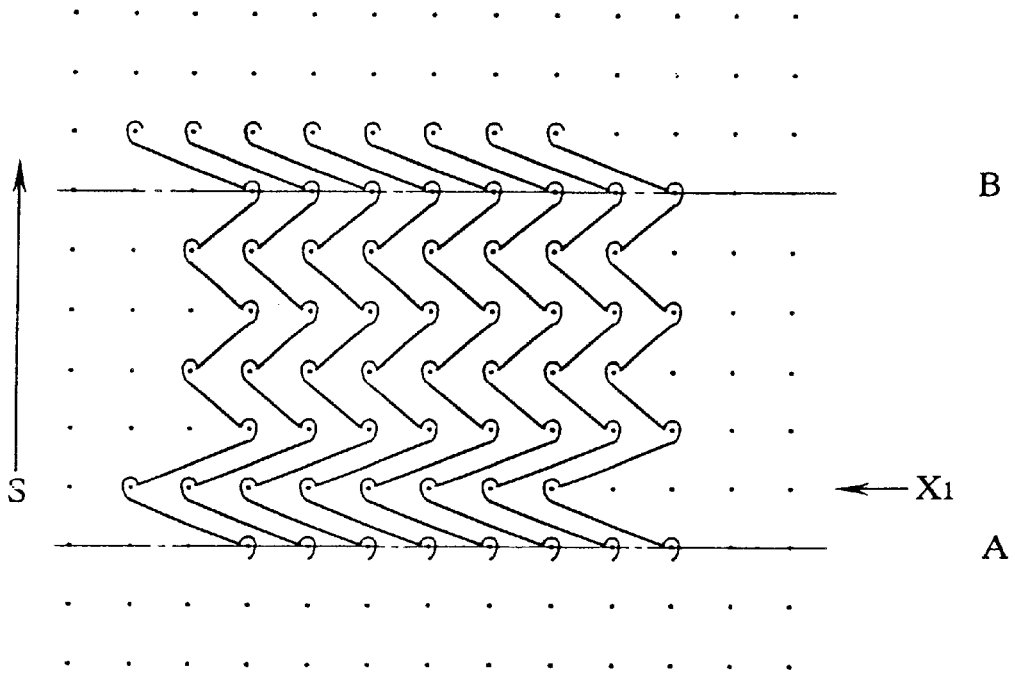
FIG. 8 is a schematic stitch representation of another embodiment of a satin type tricot stitch used in the present invention.
Figure 9:
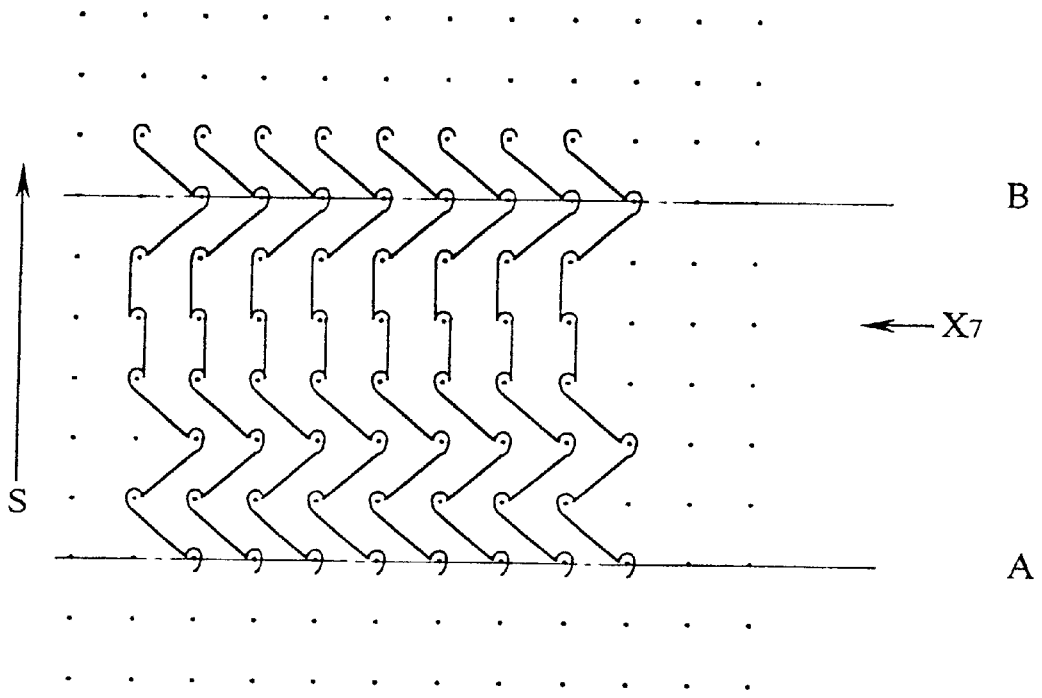
FIG. 9 is a schematic stitch representation of still another embodiment of a satin type tricot stitch used in the present invention.

FIGS. 7 to 9 are schematic stitch representations of the face side of satin type tricot stitches used in the present invention. These diagrams are illustrated in accordance with the rules commonly used in the knitting industry. Therefore, although these diagrams do not faithfully illustrate actual conditions of yarn in the knitting stitches, they are generally used by those skilled in the art.

In any of these drawings, an arrow S indicates the direction of the arrow S in FIG. 2. That is, the arrow S indicates a direction in which yarn is provided to form a satin type tricot stitch (warp knit fabric). The satin type tricot stitches shown in FIGS. 7 to 9 are only some examples, and other kinds of satin type tricot stitches may also be employed in the present invention.

FIG. 7 shows a satin type tricot stitch having a racking of three needles in the courses indicated by arrows $X_1$, $X_2$, and $X_3$ for jacquard movement, as shown by each arrow toward the left in the drawing. The stitch indicated by a dotted line at the right end in FIG. 7 is a stitch without jacquard control, shown for reference. Moreover, the portion between alternate long and short dash lines A and B is one repeat unit in FIG. 7.

The tension of yarn is increased in a portion with a racking of three needles. Therefore, the larger the proportion of a racking of three needles in one repeat unit, the stronger the straining force. The satin type tricot stitch shown in FIG. 7 has a racking of three or more needles in three courses $X_1$, $X_2$, and $X_3$ in one repeat unit, and has the strongest straining force compared with the satin type tricot stitches shown in FIGS. 8 and 9 as described below.

Next, FIG. 8 shows a satin type tricot stitch having a racking of three needles in a course indicated by an arrow $X_1$ for jacquard movement toward the left in the drawing. Furthermore, the portion between alternate long and short dash lines A and B is one repeat unit in FIG. 8. The satin type tricot stitch shown in FIG. 8 has a racking of three or more needles in only one course $X_1$ in one repeat unit, and thus has a weaker straining force than the above-mentioned satin type tricot stitch shown in FIG. 7. However, it has a stronger straining force than the satin type tricot stitch shown in FIG. 9 as described below.

Next, FIG. 9 shows a satin type tricot stitch having a racking of one needle in a course shown by an arrow $X_7$ for jacquard movement toward the left in the drawing. Furthermore, the portion between alternate long and short dash lines A and B is one repeat unit in FIG. 9. The satin type tricot stitch shown in FIG. 9 has a racking of only one needle in one course $X_7$ in a repeat unit, and has a weaker straining force than the satin type tricot stitches shown in FIGS. 7 and 8 as described above. However, it has a stronger straining force than the mesh type tricot stitch shown in FIG. 10 as described below.

Figure 10:
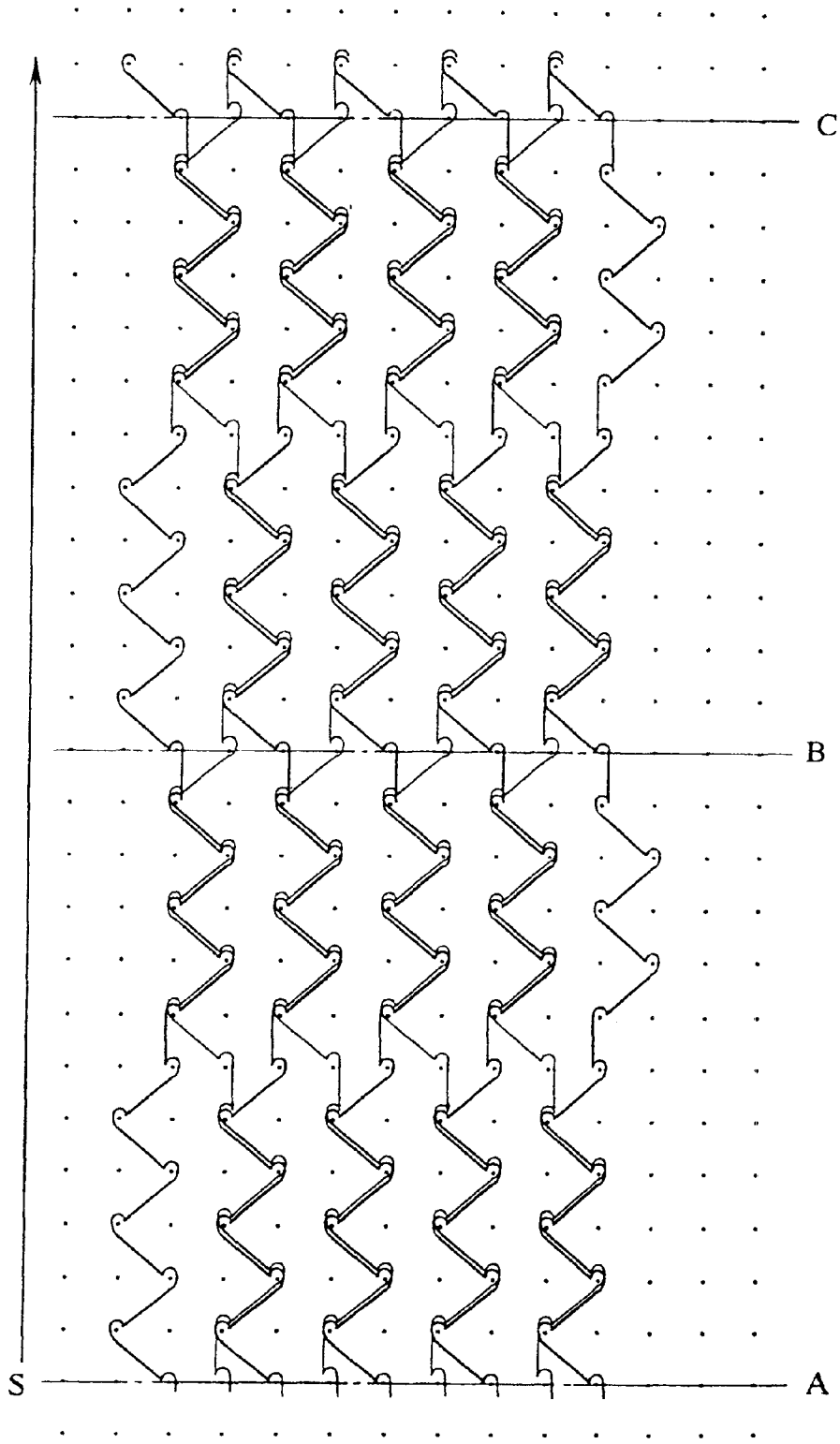
FIG. 10 is a schematic stitch representation of a mesh type tricot stitch used in the present invention FIGS. 11(*a*) and 11(*b*) are schematic stitch representations for explaining a condition in which elastic yarn is inserted in a ground stitch.

FIG. 10 is a schematic stitch representation of the face side of a mesh type tricot stitch used in the present invention.

An arrow S in FIG. 10 also indicates the direction of the arrow S in FIG. 2. That is, the arrow S indicates the direction in which yarn is provided to form a mesh type tricot stitch (warp knit fabric). The mesh type tricot stitch shown in FIG. 10 is only one example, and other kinds of mesh type tricot stitches may also be employed in the present invention.

As is also apparent from FIG. 10, a mesh type tricot stitch has large proportion of spaces and lower density of yarn per unit area than a satin type tricot stitch, and thus has a weaker straining force than the above-mentioned satin type tricot stitches in FIGS. 7 to 9. Furthermore, in FIG. 10, the portion between alternate long and short dash lines A and B and the portion between alternate long and short dash lines B and C are respectively one repeat unit. That is, the portion between A and B and the portion between B and C are the same repeated stitch.

By controlling the ground tricot stitches by way of the above-mentioned embodiment, portions with relatively strong and weak straining forces can be formed in predetermined places in predetermined patterns. In general, a satin type tricot stitch is used in a portion with a relatively strong straining force, and a mesh type tricot stitch is used in a portion with a relatively weak straining force.

Furthermore, when the portion with a relatively strong straining force is formed into patterns of portions with straining forces of two different grades as illustrated in FIG. 2, for example, any two from the satin type tricot stitches shown in FIGS. 7 to 9 may be used in combination. Also, when patterns of portions with strong straining forces of three or more grades is formed, for example, knitting stitches as shown in FIGS. 7, 8 and 9 may be used in combination. Furthermore, satin type tricot stitches shown in FIGS. 7 to 9 are just representative examples, and the present invention is not limited to these examples.

Furthermore, in the above-mentioned satin type and mesh type tricot stitches, for example, a racking of two needles can be achieved by electrically controlling yarn guide bars to which deflecting transducers using piezo elements etc. are attached, which are provided in a warp knitting machine having a jacquard control mechanism. The detail of these is described, for example, in the U.S. Pat. No. 5,390,512 (corresponding to Japanese Published Unexamined Patent Application (Tokkai) No. Hei 6-166934) as mentioned above, and particularly, a high speed jacquard raschel machine "RSJ 4/1" manufactured by Karl Mayer Textilmaschinenfabric GmbH or the like may be used.

Furthermore, each of the above-mentioned tricot stitches in the present invention is knitted by a jacquard raschel knitting machine. Moreover, the above-mentioned tricot stitches may also be knitted by a jacquard tricot knitting machine.

As inelastic yarn constituting the above-mentioned ground stitches, for example, synthetic fiber yarn such as nylon or polyester yarn, regenerated fiber yarn such as rayon, acetate, or cuprammonium rayon yarn, natural fiber yarn such as cotton, silk, flax, or wool yarn, may be used. However, nylon yarn is particularly preferably used. It is preferable to use yarn having a thickness equivalent to 20 to 80 denier of nylon yarn.

Having described cases of net or tricot stitches for ground stitches by jacquard knitting separately for easy understanding, these ground stitches are not particularly precisely distinguished, and some ground stitches are common. Generally, net stitch, tricot stitch, and the like are classified according to whether elastic yarn is inserted, or knitted by a method called looping in the stitch.

Having described above about the ground stitches, a fabric used in the present invention has such ground stitches comprising inelastic yarn, in which elastic yarn is further inserted and/or knitted (looped) in the walewise direction of the fabric. The elastic yarn may be uniformly inserted and/or knitted in the fabric, but the number and/or thickness of the elastic yarn may also be varied according to the required strength of the straining forces.

FIGS. 11(*a*) to 13(*b*) are schematic stitch representations for explaining conditions in which elastic yarn is inserted in a ground net stitch by jacquard knitting. Although those skilled in the art can usually sufficiently understand a condition in which elastic yarn is inserted, a representative example of such a condition will be described below to ensure understanding. The embodiments shown in FIGS. 11 to 13 in which elastic yarn is inserted are just some examples, and other embodiments in which elastic yarn is inserted may also be used in the present invention.

In any of FIGS. 11(*a*) to 13(*b*), using the satin type net stitch shown in FIG. 3 as an example, a condition in which yarn is inserted in the stitch is shown. Moreover, although FIG. 3 shows only the face side of the satin type net stitch, any of FIGS. 11(*a*) to 13(*b*) also illustrate the back side of the satin type net stitch. Furthermore, FIGS. 11(*b*), 12(*b*), and 13(*b*) are schematic stitch representations showing conditions in which elastic yarn is inserted in the above-mentioned satin type net stitch, and FIGS. 11(*a*), 12(*a*), and 13(*a*) are schematic stitch representations in which each component yarn is picked up and separately illustrated.

In any of these drawings, an arrow S indicates the direction in which yarn is provided.

FIGS. 11(*a*) and 11(*b*) are schematic stitch representations showing a condition in which one yarn is inserted in a satin type net stitch as a ground stitch.

In FIGS. 11(*a*) and (*b*), numeral 5 indicates inelastic yarn that appears on the face side of the satin type net stitch as a ground stitch; numeral 6 indicates inelastic yarn that appears on the back side of the satin type net stitch as a ground stitch; and numeral 7 indicates insert yarn comprising elastic yarn. FIGS. 11(*a*) and 11(*b*) show a condition in which one yarn 7 is inserted between each of wales $B_1$, $B_2$, $B_3$, $B_4$, and $B_5$. Having described the satin type net stitch shown in FIG. 3 as an example of a ground stitch, a condition in which "one yarn is inserted" has the same concept in other satin type net stitches or mesh type net or other stitches, even if the ground stitch is different, and means a condition in which one yarn is inserted between each wale.

FIGS. 12(*a*) and 12(*b*) are schematic stitch representations showing a condition in which two yarns are inserted in a satin type net stitch as a ground stitch.

In FIGS. 12 (*a*) and (*b*), numeral 5 indicates inelastic yarn that appears on the face side of the satin type net stitch as a ground stitch; numeral 6 indicates inelastic yarn that appears on the back side of the satin type net stitch as a ground stitch; and numeral 8 indicates insert yarn comprising elastic yarn. FIG. 12 shows a condition in which two yarns 8 are inserted between each of wales $B_1$, $B_2$, $B_3$, $B_4$, and $B_5$. Having described the satin type net stitch shown in FIG. 3 as an example of a ground stitch, a condition in which "two yarns are inserted" has the same concept in other satin type net stitches or mesh type net or other stitches, even if the ground stitch is different, and means a condition in which two yarns are inserted between each wale.

Next, FIGS. 13(*a*) and 13(*b*) are schematic stitch representations showing a condition in which two yarns and one yarn are alternatively inserted in a satin type net stitch as a ground stitch.

In FIGS. 13(*a*) and (*b*), numeral 5 indicates inelastic yarn that appears on the face side of the satin type net stitch as a ground stitch; numeral 6 indicates inelastic yarn that appears on the back side of the satin type net stitch as a ground stitch; and numerals 7 and 9 indicate insert yarn comprising elastic yarn. In the embodiment shown in FIGS. 13(*a*) and 13(*b*), one yarn 7 is inserted between wales $B_1$ and $B_2$; two yarns 9 are inserted between wales $B_2$ and $B_3$; one yarn 7 is inserted between wales $B_3$ and $B_4$; and two yarns 9 are inserted between wales $B_4$ and $B_5$. Having described the satin type net stitch shown in FIG. 3 as an example of the ground stitch, a condition in which "two yarns and one yarn are alternatively inserted" has the same concept in other satin type net stitches or mesh type net or other stitches, even if the ground stitch is different, and means a condition in which two yarns and one yarn are alternatively inserted between each wale.

Having described examples in which one or two yarns are inserted, other embodiments may also be used as needed. For example, an embodiment in which three or more yarns are inserted, or another embodiment in which a first section in which three or more yarns are inserted and a second section in which fewer yarns than the first section are inserted are alternatively provided. In general, when desired to obtain a relatively strong straining force, two yarns are inserted, and when desired to obtain a relatively weak straining force, one yarn is inserted.

By using the above-mentioned combination of ground stitches and insert yarn, for example, combinations of the insert yarns shown in FIGS. 11(*a*) to 13(*b*) and the straining forces of different strength provided by the ground stitches explained in FIGS. 1 to 6, and further by changing the thickness of the elastic insert yarn depending on the place where inserted, portions having straining forces at various grades of strength can be provided on a warp knit fabric.

A representative example of the above-mentioned satin type net or mesh type net stitches in which elastic yarn is inserted is spandex power net, which is used for general reference of these stitches. The stitches described with reference to FIGS. 3 to 6 and FIGS. 11(*a*) to 13(*b*) are examples of the spandex power net.

FIGS. 14(*a*) and 14(*b*) are schematic stitch representations explaining a condition of a tricot stitch in which elastic yarn is knitted (looped) in a ground stitch by jacquard knitting. The embodiment shown in FIGS. 14(*a*) and 14(*b*) in which elastic yarn is knitted is only one representative example, and in the present invention, unless the objects of the present invention are inhibited, other embodiments in which elastic yarn is knitted may also be used.

FIGS. 14(*a*) and 14(*b*) show a condition in which elastic yarn is knitted in a ground stitch, for which the satin type tricot stitch shown in FIG. 7 is used as an example.

Moreover, although FIG. 7 shows only the front side of the satin type tricot stitch, FIGS. 14(*a*) and 14(*b*) also show the back side of the satin type tricot stitch. Furthermore, FIG. 14(*b*) is a schematic stitch representation showing a condition in which elastic yarn is knitted in the above-mentioned satin type net stitch, and FIG. 14(*a*) is a schematic stitch representation in which each component yarn is picked up and separately illustrated. Moreover, the arrow S indicates the direction in which yarn is provided.

FIGS. 14(*a*) and 14(*b*) are schematic stitch representations showing a condition in which one elastic yarn is knitted in each wale in the satin type tricot stitch as a ground stitch.

In FIGS. 14(*a*) and 14(*b*), numeral 10 indicates inelastic yarn that appears on the front side of the satin type tricot stitch as a ground stitch; numeral 11 indicates inelastic yarn that appears on the back side of the satin type tricot stitch as a ground stitch; and numeral 12 indicates knitted elastic yarn. In FIGS. 14(*a*) and 14(*b*), one elastic yarn 12 is knitted in such a way that it alternatively reciprocates between a wale and its adjacent wale, with respect to each of wales $B_1$, $B_2$, $B_3$, $B_4$, and $B_5$. Having described a satin type tricot stitch shown in FIG. 7 as an example of the ground stitch, a condition in which "one elastic yarn is knitted" has the same concept in the cases of other satin type tricot stitches or mesh type tricot or other stitches, even if the ground stitch is different, and means a condition in which one elastic yarn is knitted in a wale.

Although not shown in the drawing, in the same way as in FIGS. 12(*a*), 12(*b*), 13(*a*) and 13(*b*), two elastic yarns may be knitted in a satin type tricot stitch as a ground stitch, or two elastic yarns and one elastic yarn may be alternatively knitted in each wale. Other embodiments may also be employed as needed, for example, an embodiment in which three or more yarns are knitted, or another embodiment in which a first section in which three or more elastic yarns are knitted and a second section in which fewer elastic yarns than the first section are knitted are alternatively provided. In general, when desired to obtain a relatively strong straining force, two elastic yarns are knitted, and when desired to obtain a relatively weak straining force, one elastic yarn is knitted.

By using the above-mentioned combinations of the ground stitches and knitted elastic yarn, for example, combinations of the above-mentioned embodiments of knitted elastic yarn, and the straining forces of different strength provided by the ground tricot stitches explained in FIGS. 7 to 10, and further by changing the thickness of the elastic yarn depending on the place where knitted, portions with straining forces at various grades of strength can be provided on a warp knit tricot fabric.

A representative example of the above-mentioned satin type tricot or mesh type tricot stitches in which elastic yarn is knitted (looped) is all-way stretch tricot, which is used for general reference of these stitches. The stitches described above with reference to FIGS. 7 to 10 and FIGS. 14(*a*) and 14(*b*) are examples of the all-way stretch tricot.

The types of elastic yarn used as insert yarn or knit-in yarn are not particularly limited, but polyurethane fiber yarn is preferably used.

The thickness of the elastic yarn may be selected as appropriate depending on the type of the garment used, the type of the ground stitch, and which part of the garment the elastic yarn is applied. Particularly, when varied straining force is achieved by the change of the thickness of the elastic yarn, elastic yarns ranging from a relatively thin yarn to a relatively thick yarn may be employed. Usually, depending on the type of each product or the purpose of using the elastic yarn, elastic yarn with a suitable thickness selected from the range of 40 to 560 denier may be used.

In the following, specific garments will be described referring to the drawings. However, the present invention is not limited only to these garments.

Figure 15:
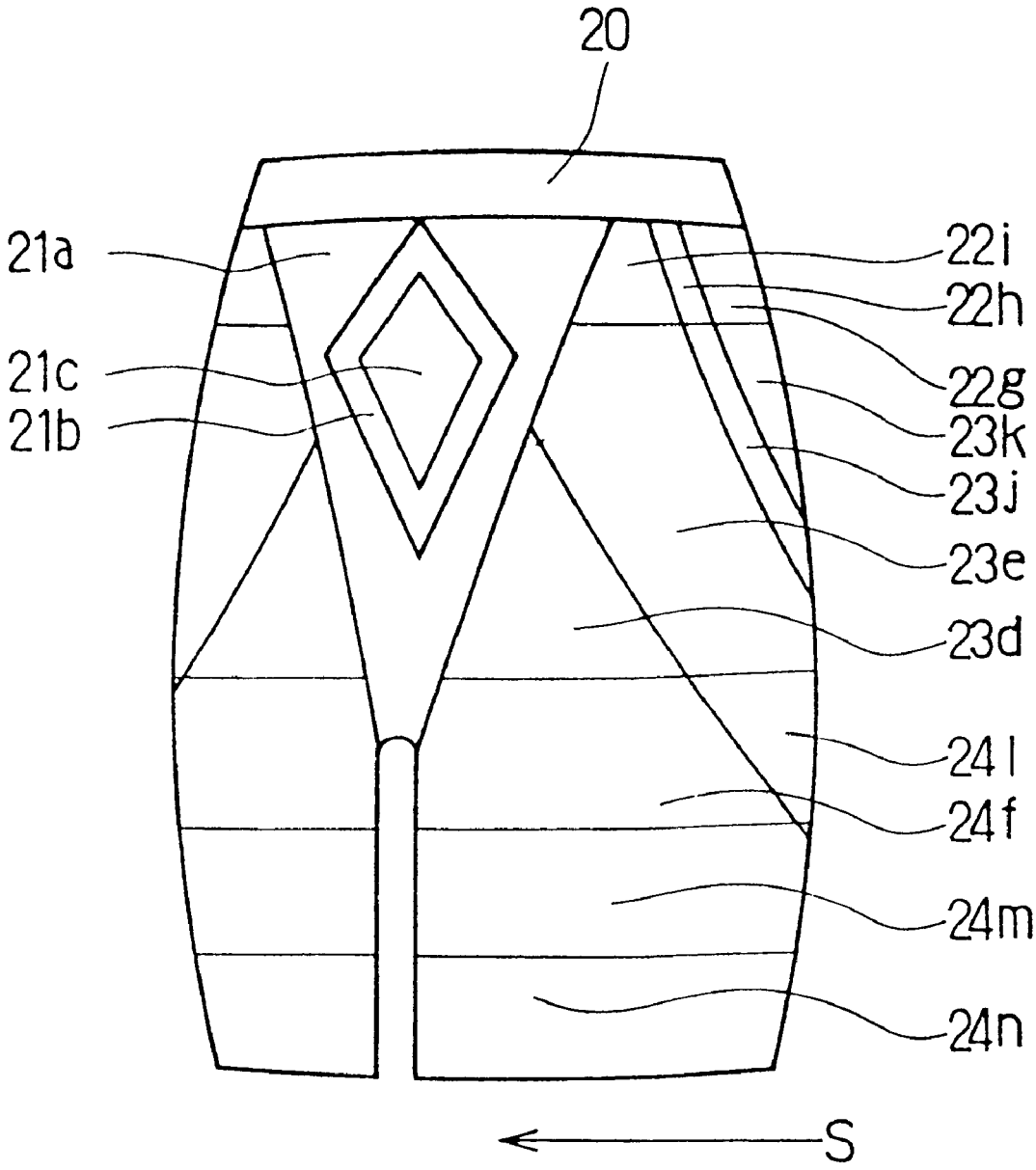
FIG. 15 is a perspective view from the front side of a long type girdle as a garment of the present invention.
Figure 16:
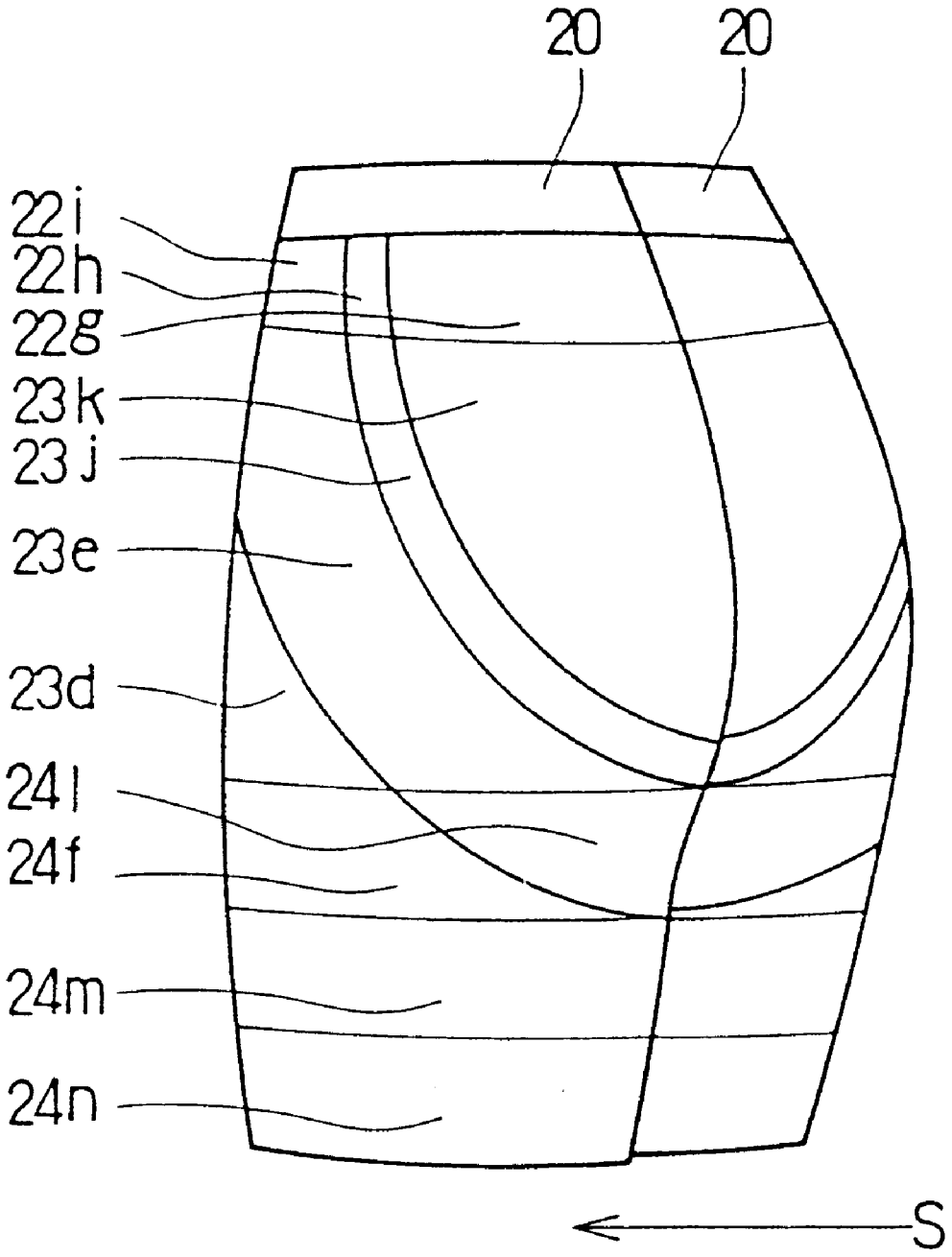
FIG. 16 is a perspective view from the back side of the long type girdle shown in FIG. 15.
Figure 17:
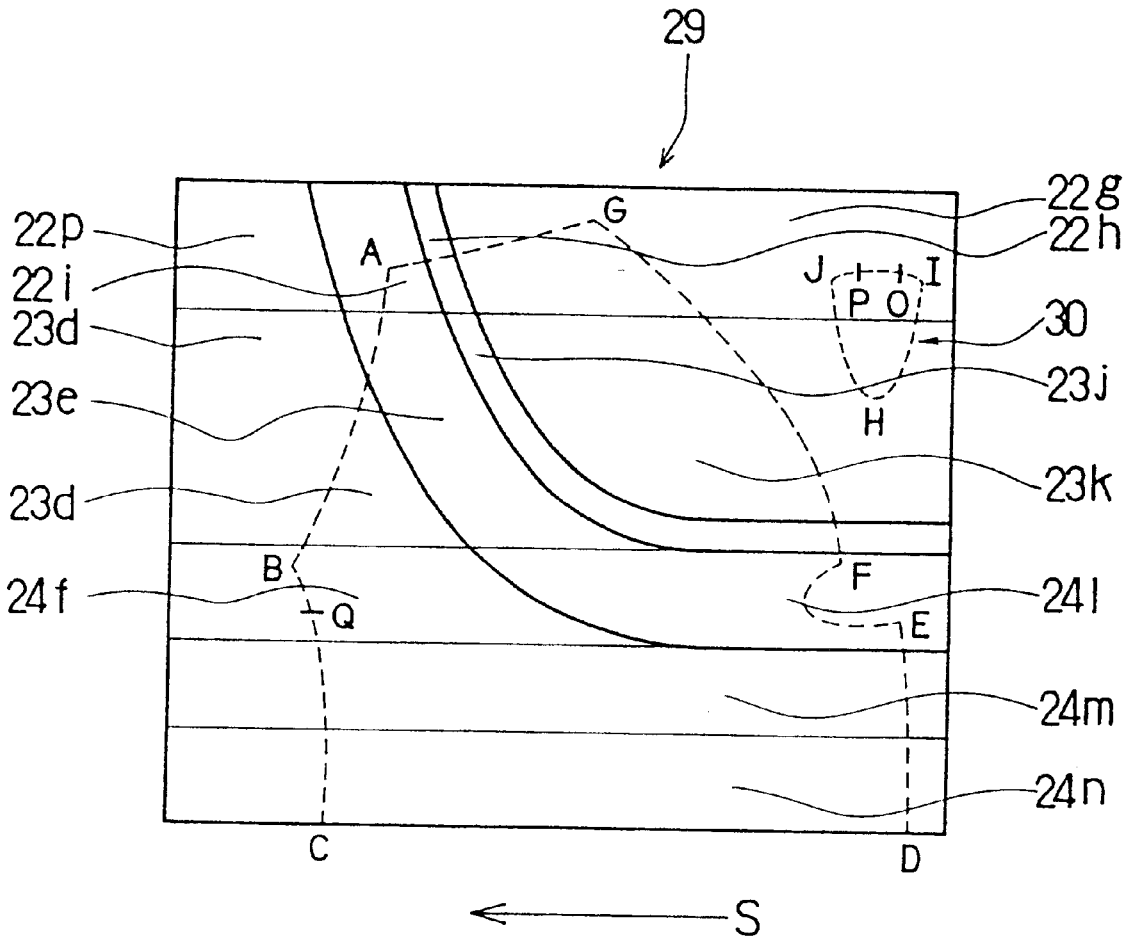
FIG. 17 is a plan view of a fabric mainly used for from the back to the side front part and the leg part of the girdle shown in FIGS. 15 and 16 before being cut.
Figure 18:
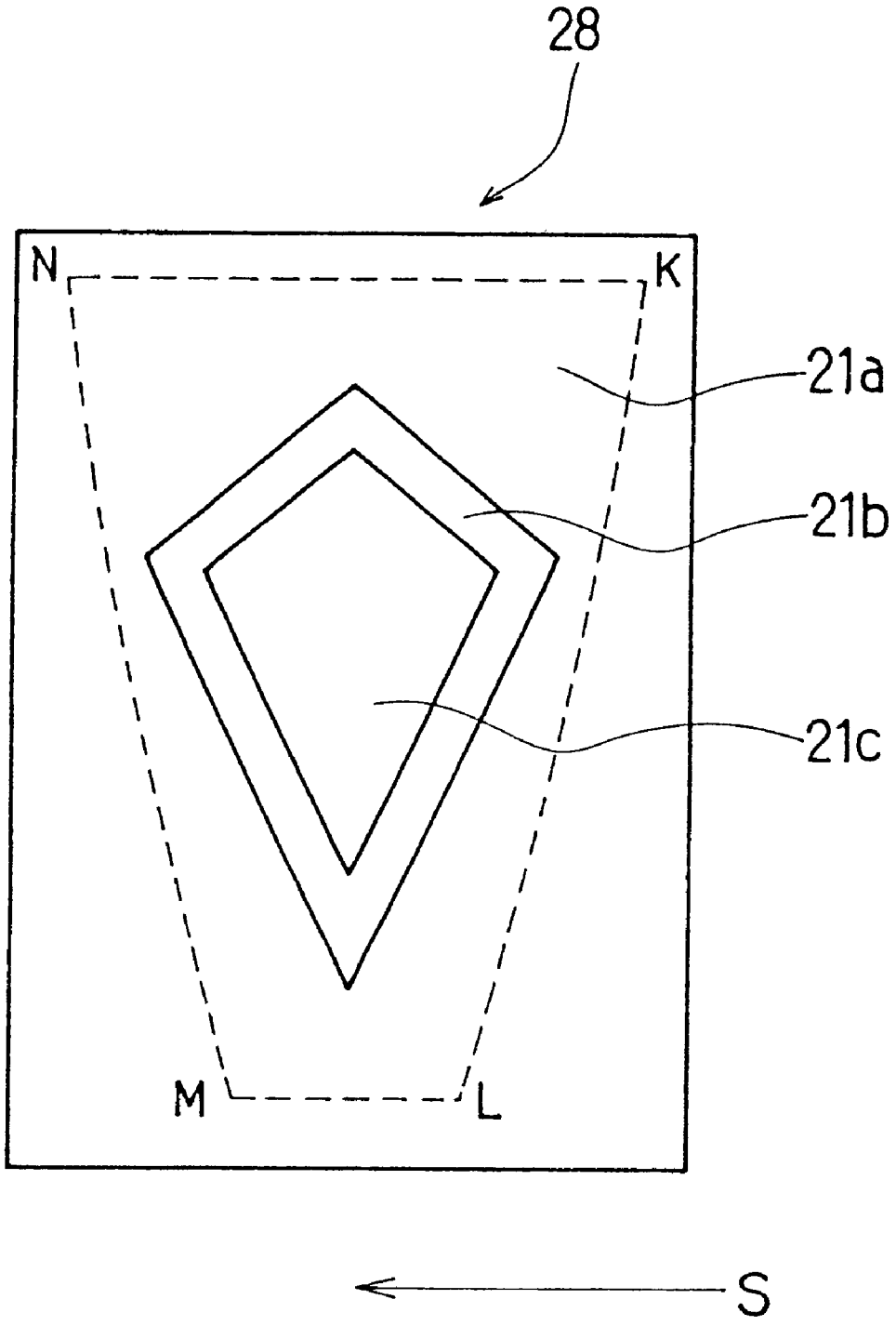
FIG. 18 is a plan view of a fabric for an abdomen cloth piece used for the front abdomen part of the girdle shown in FIGS. 15 and 16 before being cut.

FIG. 15 is a perspective view from the front side of a long type girdle as a garment of the present invention; and FIG. 16 is a perspective view from the back side thereof. Furthermore, FIG. 17 is a plan view of a fabric mainly used for from the back to the side front part and the leg part of the above-mentioned girdle shown in FIGS. 15 and 16 before being cut; and FIG. 18 is a plan view of a fabric for an abdomen cloth piece used for a front abdomen part of the girdle shown in FIGS. 15 and 16 before being cut. In FIGS. 15 to 18, an arrow S indicates the same direction of the arrow S as shown in FIGS. 1 to 6 and FIGS. 11 to 13.

In a peripheral part 21*a*, a second abdomen-press part 21*b*, and a first abdomen-press part 21*c* of the abdomen cloth piece, including other portions of a fabric 28, nylon yarn of 40 denier is used in the ground stitch, and one polyurethane yarn of 280 denier is used as insert yarn. The ground stitch of the peripheral part 21*a* of the abdomen cloth piece is a mesh type net stitch; the ground stitch of the second abdomen-press part 21*b* is a satin type net stitch as explained in FIG. 5; and the ground stitch of the first abdomen-press part 21*c* is the satin type net stitch having a racking of two needles in large proportion as explained in FIG. 3. Therefore, the order of the strength of the straining forces is 21*c*>21*b*>21*a*. The part 21*a* corresponds to the portion with a relatively weak straining force, the part 21*b* corresponds to the portion with a relatively strong straining force, and the part 21*c* corresponds to the portion with a further strong straining force. Parts 22*g* and 23*k* are first hip covering parts for covering substantially the main part of the hip of a wearer's body; parts 22*h* and 23*j* are second hip covering parts provided for covering from beneath the bulge of the hip to the side of the wearer's body in a band shape, surrounding the first hip covering parts 22*g* and 23*k*; and parts 22*i*, 23*e*, and 24*l* are hip and side abdomen covering parts which are provided in a band shape for covering from below the bulge of the hip to the side abdomen of the wearer's body to keep an upward profile for the hip line, and are located in further outer side of the second hip covering parts 22*h* and 23*j*. A part 23*d* is a lower side abdomen covering part for covering a lower region of the side abdomen. Parts 24*f*, 24*m*, 24*n* are leg covering parts for covering the leg. Furthermore, a cloth piece 30 for a crotch is not particularly limited, and for example, it may be cut from any unused part of a fabric 29 as appropriate as shown in FIG. 17. Moreover, the material of the cloth piece for the waist covering part 20 shown in FIGS. 15 and 16 does not particularly relate to the present invention, and it is a fabric stretchable at least in the lateral direction of the girdle, which is used, for example, by folding it double. This example uses a one-way stretch plain power net which is stretchable in the lateral direction of the garment, in which nylon yarn of 40 denier is used in the ground stitch, and one polyurethane yarn of 280 denier is used as insert yarn. However, it is not particularly limited to this example, and a stretch tape or the like may also be attached to the inner side of the material as needed. Moreover, the part 22*p* shown in FIG. 17 is a portion not used in the girdle and is discarded. The ground stitch of the part 22*g* comprises the satin type net stitch as explained in FIG. 5; the ground stitch of the part 22*h* comprises the satin type net stitch having a racking of two needles in a larger proportion as explained in FIG. 4; the ground stitch of the part 22*i* comprises the satin type net stitch having a racking of two needles in the largest proportion as explained in FIG. 3; and the ground stitch of the part 22*p* comprises the mesh type net stitch as explained in FIG. 6. In any of these parts, nylon yarn of 40 denier is used in the ground stitch, and two polyurethane yarns of 140 denier are inserted.

The ground stitch of the part 23*k* comprises a mesh type net stitch; the ground stitch of the part 23*j* comprises the satin type net stitch as explained in FIG. 5; the ground stitch of the part 23*e* comprises the satin type net stitch having a racking of two needles in large proportion as explained in FIG. 3; and the ground stitch of the part 23*d* comprises a mesh type net stitch. In any of these parts, nylon yarn of 40 denier is used in the ground stitch, and one polyurethane yarn of 140 denier is inserted.

The ground stitch of the part 24*l* comprises the satin type net stitch having a racking of two needles in large proportion as explained in FIG. 3; the ground stitch of the part 24*f* comprises a mesh type net stitch; the ground stitch of the part 24*m* comprises a mesh type net stitch; and the ground stitch of the part 24*n* comprises the satin type net stitch having a racking of two needles in large proportion as explained in FIG. 3. In any of these parts, nylon yarn of 40 denier is used in the ground stitch, and two polyurethane yarns of 140 denier are inserted.

In FIG. 17, a dotted line A-B-C-D-E-F-G-A shown in the fabric 29 indicates a cutting line to obtain a body fabric for the left half body of a wearer used for from the side to the back part and the leg part of the girdle. Furthermore, a dotted line H-I-J-H shown in the fabric 29 indicates a cutting line to obtain a cloth piece 30 for the crotch part of the girdle. In FIG. 18, a dotted line K-L-M-N-K shown in the fabric 28 indicates a cutting line to obtain an abdomen cloth piece comprising the peripheral part 21*a*, the second abdomen-press part 21*b*, and the first abdomen-press part 21*c*. Although not shown in the drawing, a cutting line to obtain a body fabric for the right half body of a wearer used for from the side to the back part and the leg part of the girdle is symmetrical with the cutting line shown in FIG. 17. A-B line is sewn with K-L line, Q-C line is sewn with E-D line to form the left leg part, and G-F line is sewn with the same part of the right half body fabric as described above but not shown in the drawing, to form a center rear seam line. O-P line of the crotch cloth piece 30 is sewn with L-M line in FIG. 18, O-I line is sewn with B-Q line, and H-I line is sewn with F-E line. The right half body fabric as described above but not shown in the drawing is also sewn in the same way, since it is symmetrical with the left half body fabric. A cloth piece for the waist covering part 20 is attached thereto by sewing at the N-K and A-G lines, and also at a line corresponding to the A-G line in the right half body fabric not shown in the drawing, so that the girdle shown in FIGS. 15 and 16 can be produced.

The straining forces of the respective parts of this long type girdle are ranked approximately in the order from the strongest as follows: the parts 21*c*, 22*i*, 24*l*, and 24*n* are the first; the part 22*h* is the second; the parts 21*b* and 22*g* are the third; the parts 21*a*, 24*f*, 24*m*, and 22*p* are the fourth; the part 23*e* is the fifth; the part 23*j* is the sixth; and the parts 23*d* and 23*k* are the seventh or the weakest.

If forced to classify, the above-mentioned first to the third strongest parts fall in the class of the portion with a relatively strong straining force, and other parts fall in the class of the portion with a relatively weak straining force. However, this example can develop seven levels of straining forces from the portion with the strongest straining force to the portion with the weakest straining force.

According to this embodiment, the shape of the hips can be controlled, the abdomen can be prevented from swelling, the hem part 24*n* can be prevented from sliding-up caused by a wearer's movement, and the thighs can be controlled to a slim shape. Moreover, by providing a straining force depending on required strength to each part, so that unnecessary straining force may not be applied to a portion in which much straining force is not needed, decrease in wearing comfort can be prevented. Also, a garment having substantially no difference in level at a boundary between portions having different straining forces, thus being free of a problem in which a difference in level is reflected in an outer wear and is seen from outside thereof, keeping a wearer's fine appearance, and also having a required figure control function, can be provided. Furthermore, in the garment according to this embodiment, breathability is not reduced, stuffiness is difficult to develop, and skin touch is not deteriorated, compared with a garment coated with a synthetic resin solution. Moreover, compared with a circular knit fabric, finished dimensions are stable, products with same finished dimensions can be easily manufactured on a large scale, durability is good, and productivity is excellent. Furthermore, the lowest edge of the hem part, i.e. the part 24*n*, does not require a finishing such as folding back followed by sewing. Because a knitting method which does not need such a finishing of the edge is well known, its explanation is omitted. However, a method of thread pull-out is usually applied.

Although the above-mentioned girdle is one embodiment of a girdle for normal use, depending on its object, it may be modified into other various embodiments.

Girdles of the present invention include, for example, girdles for pregnant women. An embodiment which applies the present invention to a girdle for pregnant women is briefly described as follows: For example, a portion with a relatively strong straining force is provided in an approximately band-shaped pattern extending from a region lower than the center of the abdomen and obliquely upward to the right and left sides on the front side of the girdle. Also, a knitting stitch with a relatively weak straining force is used in the abdomen part surrounded by the above-mentioned portion with a relatively strong straining force. This embodiment is applicable, for example, to a long or short type girdle or short panty for pregnant women.

Figure 19:
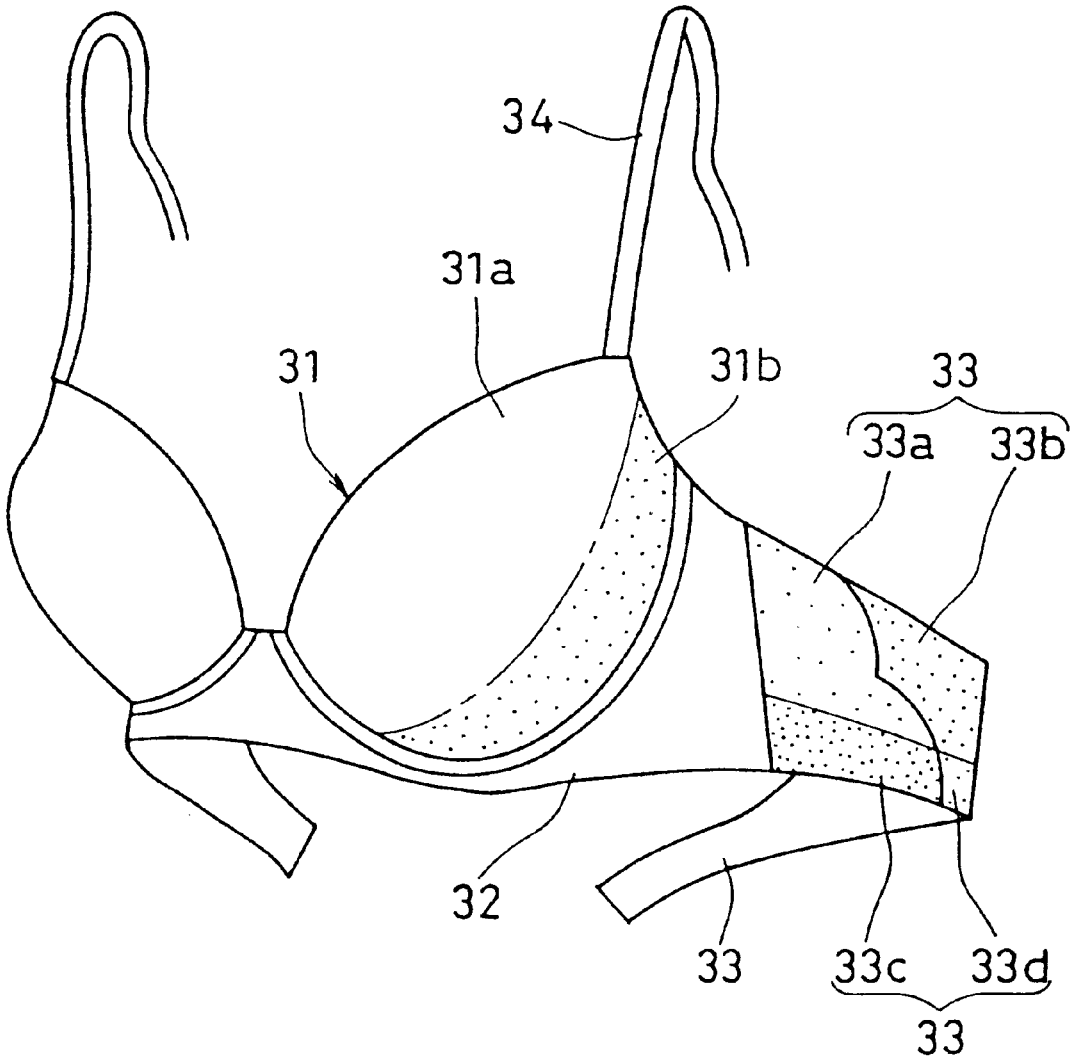
FIG. 19 is a perspective view from the front side of a brassiere as a garment of the present invention.

Next, FIG. 19 shows a perspective view from the front side of a brassiere as a garment of the present invention. In this example of a brassiere, a technique of the present invention that portions with relatively strong and weak straining forces are provided in patterns, is applied to the cups of the brassiere and to portions of the back cloth piece corresponding to the sides of a wearer's body. Numeral 31 denotes a cup of the brassiere; numeral 32 denotes a ground cloth piece; numeral 33 denotes a back cloth piece; and numeral 34 denotes a strap.

In this brassiere, the ground stitch of the part 31*b* from a lower region to the side of the cup 31 is the satin type net having a racking of two needles in large proportion as explained in FIG. 3 comprising nylon yarn of 40 denier, in which one polyurethane yarn of 140 denier is inserted. The ground stitch of an upper part 31*a* of the cup 31 is a mesh type net comprising nylon yarn of 40 denier, in which one polyurethane yarn of 140 denier is inserted. Furthermore, in the portions of the back cloth piece corresponding to the sides of a wearer's body, the ground stitches of the parts 33*a* and 33*c* are the satin type net having a racking of two needles in large proportion as explained in FIG. 3, and the ground stitches of the parts 33*b* and 33*d* are the satin type net stitch as explained in FIG. 5. In the parts 33*a* and 33*b*, one polyurethane yarn of 280 denier is inserted. Also, in the parts 33*c* and 33*d*, two polyurethane yarns of 280 denier are inserted.

According to this embodiment, the part 31*b* keeps the breast in an upward profile and also moves it toward the center front, so that the shape of the breasts can be finely controlled. Furthermore, superfluous flesh of the side breast area is prevented from swelling by the parts 33*a*, 33*b*, 33*c* and 33*d*, so that a neat and slim line of the breasts can be achieved. The part 31*a* falls in the class of the portion with a relatively weak straining force, and the parts 33*a*, 33*b*, 33*c*, and 33*d* fall in the class of a portion with a relatively strong straining force. Moreover, the part 33*c* has the strongest straining force, and the part 31*a* has the weakest straining force. Also, a garment having substantially no difference in level at a boundary between portions having different straining forces, thus being free of a problem in which a difference in level is reflected in an outer wear and is seen from outside thereof, keeping a wearer's fine appearance, and also having a required figure control function, can be provided. Furthermore, compared with a garment coated with a synthetic resin solution, breathability is not reduced, stuffiness is difficult to develop, and skin touch is not deteriorated.

Figure 20:
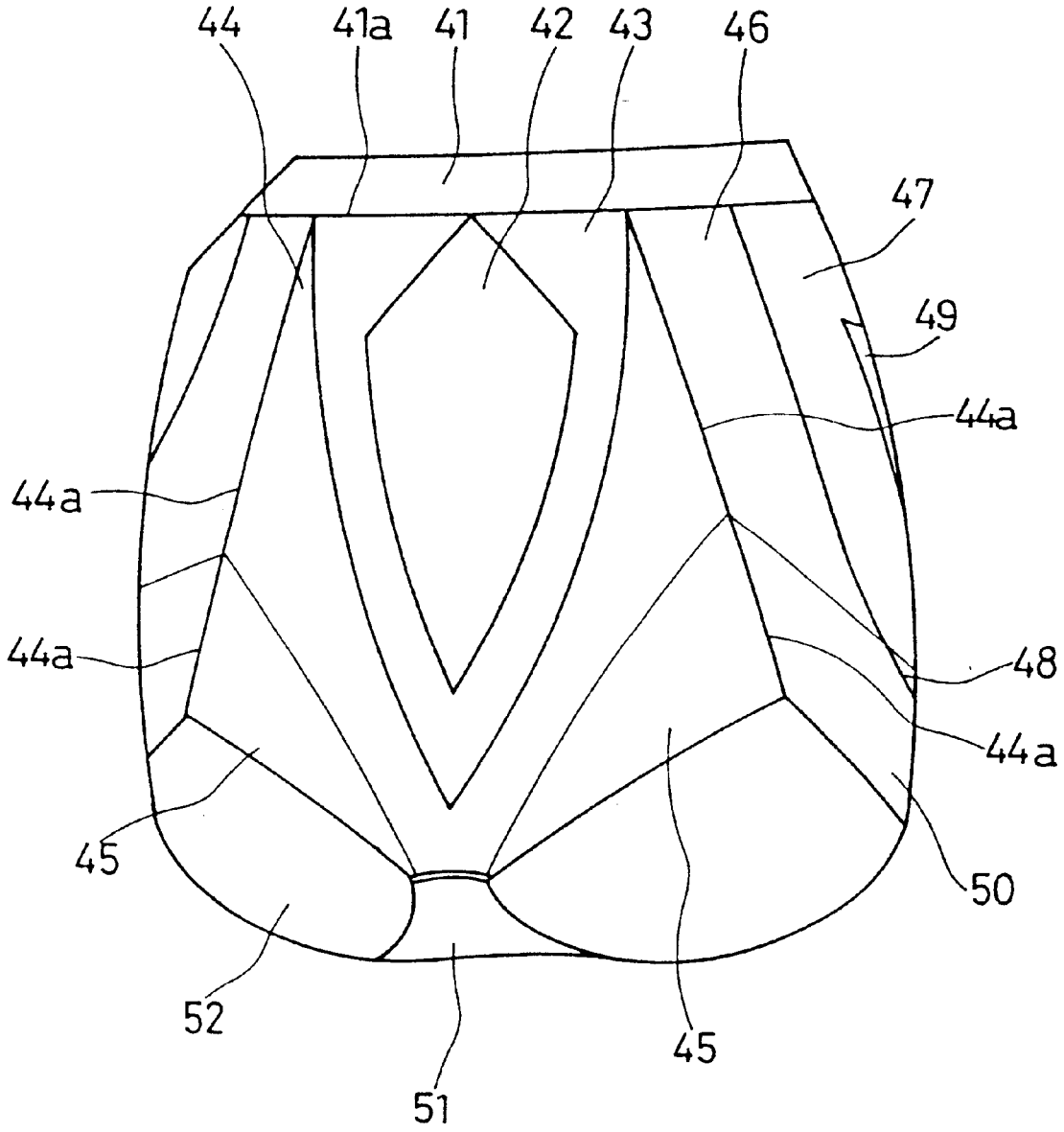
FIG. 20 is a perspective view from the front side of a short panty as a garment of the present invention.
Figure 21:
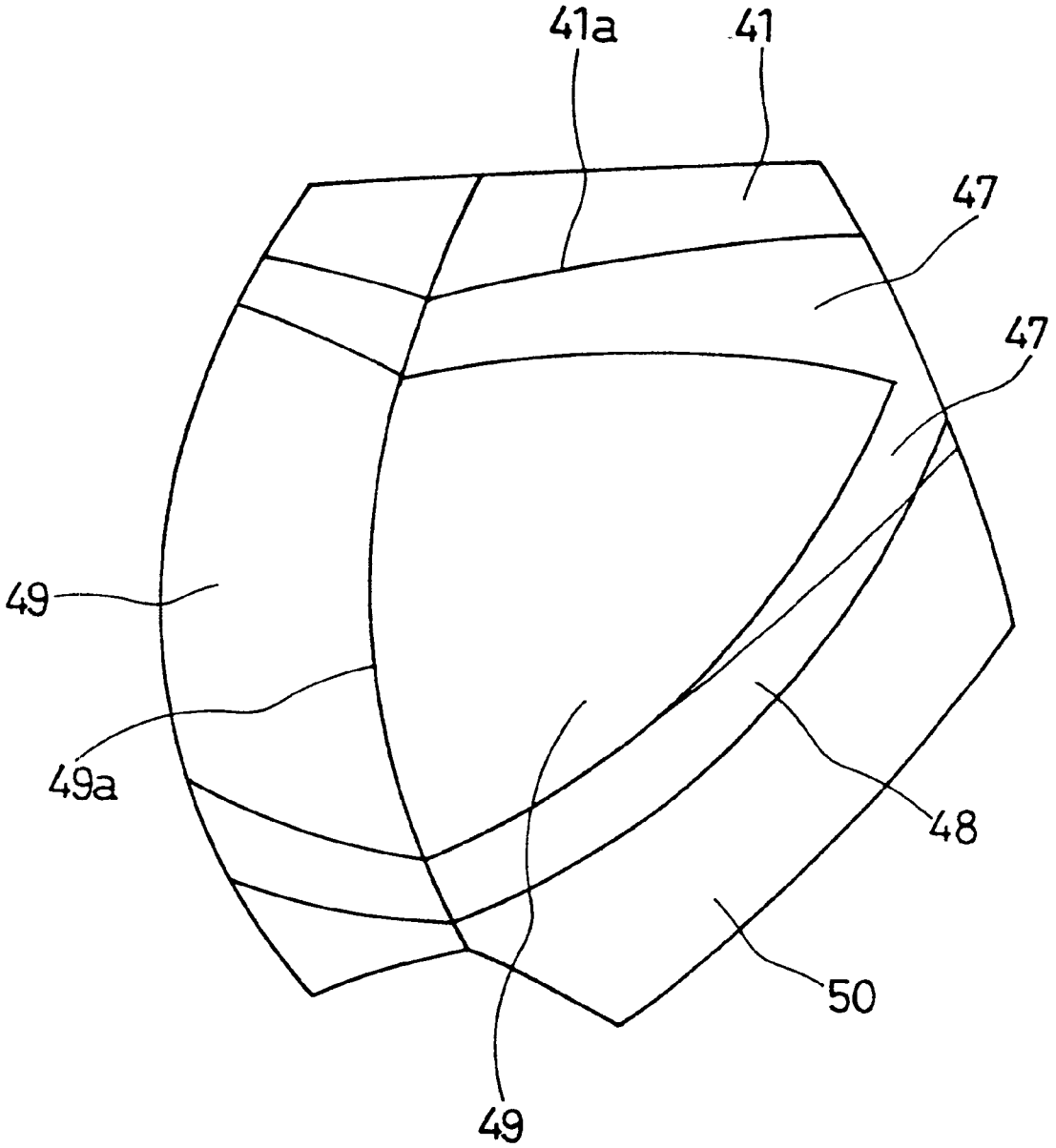
FIG. 21 is a perspective view from the back side of the short panty shown in FIG. 20.

Next, FIG. 20 is a perspective view from the front side of a short panty as a garment of the present invention; and FIG. 21 is a perspective view from the back side thereof. In this short panty, material of the fabric for a waist covering part 41 does not particularly relate to the present invention, and a fabric stretchable at least in the lateral direction of the short panty may be used, for example, by folding it double. This example uses a one-way stretch plain power net stretchable in the lateral direction of the garment, in which nylon yarn of 40 denier is used in the ground stitch, and one polyurethane yarn of 280 denier is inserted. However, it is not particularly limited, and a stretch tape or the like may also be attached to the inner side of the material as needed. The reference sign 41*a* indicates a seam line at which the waist covering part 41 is sewn to the main part of the garment.

Numeral 42 denotes an abdomen-press part of the abdomen cloth piece; numeral 43 denotes an intermediate peripheral part of the abdomen cloth piece; numeral 44 denotes an outermost peripheral part of the abdomen cloth piece; and numeral 45 indicates a front hem part. These parts comprise a continuous cloth piece. Reference sign 44*a* indicates a seam line between this cloth piece and a side front covering part 46.

Numeral 46 indicates the side front covering part; numeral 47 indicates a hip periphery covering part; numeral 48 also denotes a hip periphery covering part; numeral 49 denotes a hip covering part; numeral 50 indicates a rear hem part; and numeral 49*a* indicates a center rear seam line. These parts 46, 47, 48, 49, and 50 for the right and left bodies comprise one continuous cloth piece respectively. These cloth pieces for the right and left bodies are sewn at the seam line 49*a*.

The above-mentioned front body fabric comprising the parts 42, 43, 44, and 45 is sewn with the rear body fabric comprising the parts 46, 47, 48, 49, and 50 at the seam line 44*a*. Numeral 51 indicates a crotch part comprising another cloth piece. Numeral 52 denotes a leg hole. To be precise, the back side of the parts 50 and 48 is seen through the leg hole 52. However, these are omitted in the drawing, because it may complicate the drawing if illustrated. The rear hem part can be readily understood from FIG. 21.

The ground stitch of the part 42 is the satin type net having a racking of two needles in large proportion as explained in FIG. 3 (hereinafter may be abbreviated as "strong satin type net"); the ground stitch of the part 43 is the satin type net as explained in FIG. 5 (hereinafter may be abbreviated as "weak satin type net"); the ground stitch of the part 44 is a mesh type net; and the ground stitch of the part 45 is the strong satin type net. In these parts 42, 43, 44, and 45, nylon yarn of 40 denier is used in the ground stitch, and one polyurethane yarn of 280 denier is inserted in all of these parts.

The ground stitch of the parts 46 and 50 is the strong satin type net; the ground stitches of the parts 47 and 48 are the weak satin type net; and the ground stitch of the part 49 is a mesh type net. In these parts 46, 47, 48, 49 and 50, nylon yarn of 40 denier is used in the ground stitch, and furthermore, one polyurethane yarn of 140 denier is inserted in the parts 46, 47 and 49, and two polyurethane yarns of 140 denier are inserted in the parts 48 and 50.

According to this embodiment, because the bulge of the hips is covered by the parts 49 with a relatively weak straining force, natural roundness of the hips is not broken, and a fine round hip line can be developed. Furthermore, the hips are prevented from sagging and are kept in a high position by the parts 48 and 47. Moreover, a wearer's thighs are firmly held by the parts 45 and 50, so that a fine line of the wearer's legs can be developed. Also, at the front side, the part 42 prevents superfluous flesh of the abdomen from swelling, the part 46 prevents superfluous flesh of the abdomen from swelling toward the sides.

Also, a short panty having substantially no difference in level at a boundary between portions having different straining forces, thus being free of a problem in which a difference in level is reflected in an outer wear and is seen from outside thereof, keeping a wearer's fine appearance, and also having a required figure control function, can be provided. In addition, compared with a garment coated with a synthetic resin solution, breathability is not reduced, stuffiness is difficult to develop, and skin touch is not deteriorated. Moreover, compared with a circular knit fabric, finished dimensions are stable, products with same finished dimensions can be easily manufactured on a large scale, durability is good, and productivity is excellent. Furthermore, the lowest edge of the hem parts, i.e. the parts 50 and 45, does not need a finishing such as folding back followed by sewing. Because a knitting method which does not need such a finishing of the edge is well known, its explanation is herein omitted. However, for example, a method of thread pull-out disclosed in Japanese Published Examined Utility Model Application (Jikkou) No. Sho 47-9946 may be applied.

Moreover, the above-mentioned embodiment shown for a short panty is also applicable, for example, to a short type girdle or the like. In general, a girdle requires stronger straining force than a short panty as a whole. Therefore, in order to apply the above-mentioned embodiment for a short panty to a short type girdle, it is preferable, for example, that each yarn used has a considerably large thickness. Particularly, when the embodiment shown in FIGS. 20 and 21 is used as a short type girdle, the thickness of yarn is, for example, as follows. However, it is of note that this is only one non-limiting example.

The ground stitch of the part 42 is the strong satin type net having a racking of two needles in large proportion as explained in FIG. 3; the ground stitch of the part 43 is the weak satin type net as explained in FIG. 5; the ground stitch of the part 44 is a mesh type net; and the ground stitch of the part 45 is the strong satin type net. In these parts 42, 43, 44, and 45, nylon yarn of 30 denier is used in the ground stitch, and one polyurethane yarn of 210 denier is inserted.

The ground stitches of the parts 46 and 50 are the strong satin type net; the ground stitches of the part 47 and 48 are the weak satin type net; and the ground stitch of the part 49 is a mesh type net. In these parts 46, 47, 48, 49, and 50, nylon yarn of 30 denier is used in the ground stitch. With regard to the insert yarn, one polyurethane yarn of 100 denier is inserted in the parts 46, 47 and 49, and two polyurethane yarns of 100 denier are inserted in the parts 48 and 50.

According to this embodiment, the bulge of the hips is covered by the part 49 with a relatively weak straining force, so that natural roundness of the hips is not broken, and a fine round hip line can be developed. Furthermore, the hips are prevented from sagging and are kept in a high position by the parts 48 and 47. Moreover, a wearer's thighs are firmly held by the parts 45 and 50, so that a fine line of the wearer's legs can be developed. At the front side, the part 42 prevents superfluous flesh of the abdomen from swelling, and also the part 46 prevents superfluous flesh of the abdomen from swelling toward the sides.

Also, a short type girdle having substantially no difference in level at a boundary between portions having different straining forces, and thus being free of a problem in which a difference in level is reflected in an outer wear and is seen from outside thereof, keeping a wearer's fine appearance, and also having a required figure control function, can be provided. In addition, compared with a garment coated with a synthetic resin solution, breathability is not reduced, stuffiness is difficult to develop, and skin touch is not deteriorated. Moreover, compared with a circular knit fabric, finished dimensions are stable, products with same finished dimensions can be easily produced in a large amount, durability is good, and productivity is excellent. Furthermore, the lowest edge of the hem parts, i.e. the parts 50 and 45, does not require a finishing such as folding back followed by sewing.

Figure 22:
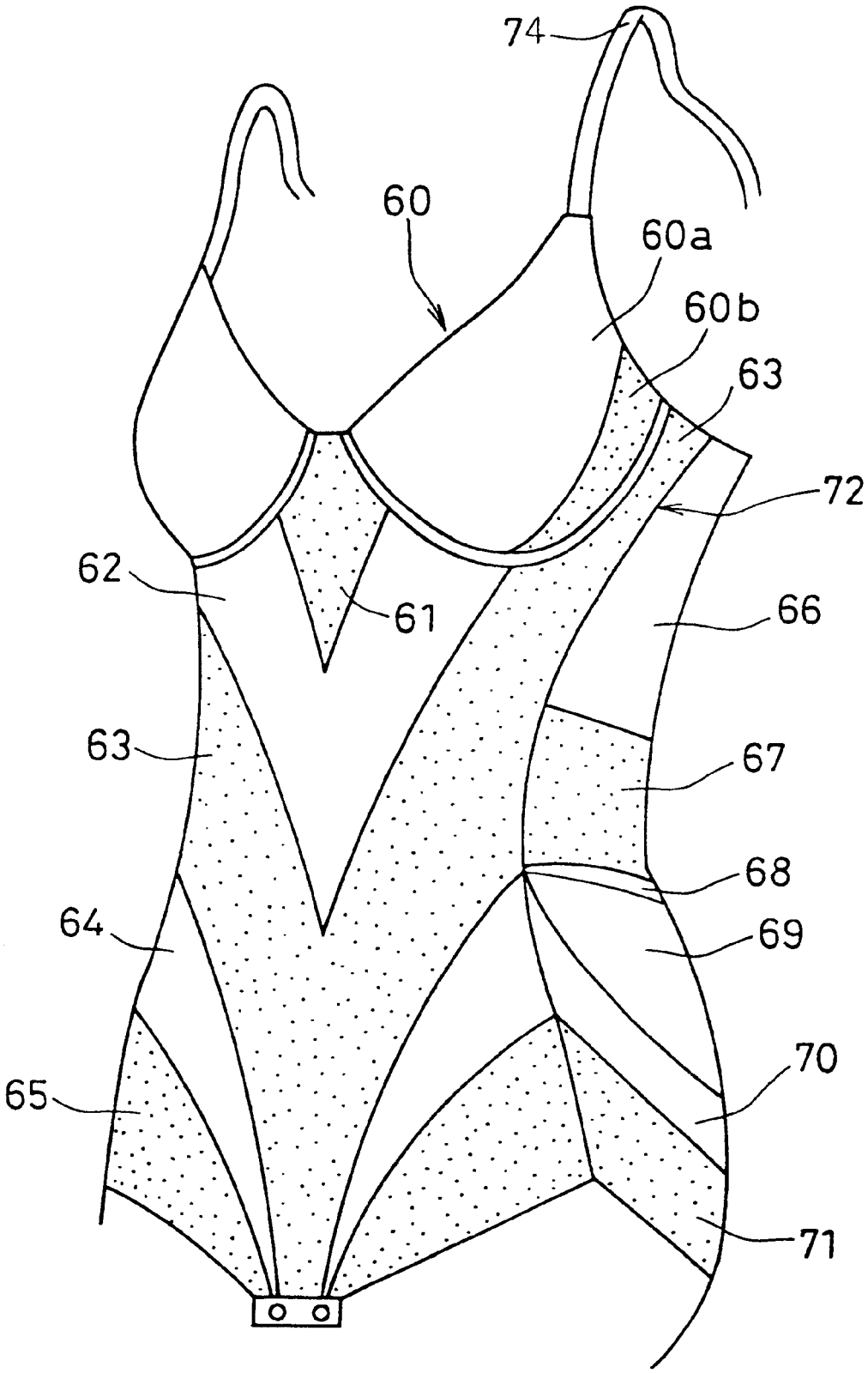
FIG. 22 is a perspective view from the front side of a body suit as a garment of the present invention.
Figure 23:
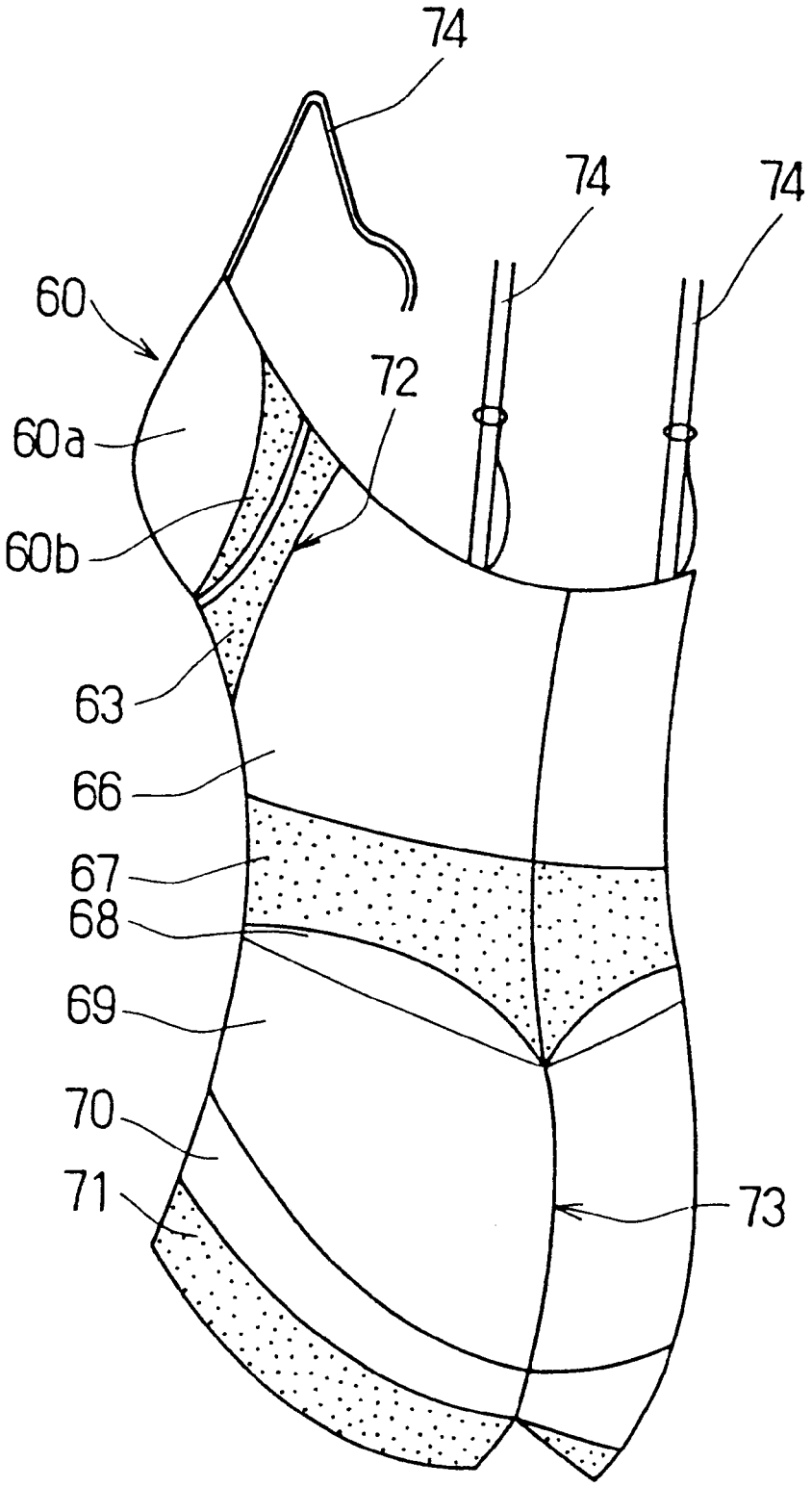
FIG. 23 is a perspective view from the back side of the body suit shown in FIG. 22.

Next, FIG. 22 is a perspective view from the front side of a body suit as a garment of the present invention; and FIG. 23 is a perspective view from the back side thereof. In FIG. 22, a lower rear hem portion is omitted in the drawing. This portion can be understood by referring to FIG. 23. Moreover, right breast cup and its vicinities and right side and its vicinities, which should appear between the straps, are omitted in FIG. 23, because these may complicate the drawing and make it difficult to understand. In addition, these can be sufficiently understood from FIG. 22.

In this body suit, numeral 60 indicates a breast cup, which is substantially the same as the cup of the brassiere described above with reference to FIG. 19. The ground stitch of a part 60*b* for from a lower region to the side of the cup 60 is the strong satin type net comprising nylon yarn of 40 denier, in which two polyurethane yarns of 140 denier are inserted. The ground stitch of an upper part 60*a* of the cup 60 is a mesh type net comprising nylon yarn of 40 denier, in which one polyurethane yarn of 140 denier is inserted. According to this embodiment, the breasts are kept in an upward profile and are also moved toward the center front by the part 60*b*, so that the breasts can be controlled to a fine shape.

Numeral 61 indicates a center front part provided between two cups 60; numeral 62 indicates a lower breast and upper abdomen covering part; numeral 63 indicates a side front and abdomen covering part; numeral 64 indicates a lower and side abdomen covering part; and numeral 65 indicates a front hem part. These parts comprise a continuous cloth piece. Numeral 66 indicates a back covering part; numeral 67 indicates a side and back waist covering part; numeral 68 indicates an upper hip covering part; numeral 69 indicates a main hip covering part; numeral 70 indicates a lower hip covering part; and numeral 71 indicates a rear hem part. These parts for the right and left bodies are symmetric with respect to a center rear seam line 73. The parts 66, 67, 68, 69, 70 and 71 for the left body, as well as the equivalent parts for the right body, respectively comprise a continuous cloth piece. Numeral 72 denotes a seam line between a front body fabric comprising the parts 61, 62, 63, 64 and 65, and a back body fabric comprising the parts 66, 67, 68, 69, 70 and 71. Numeral 73 denotes a center rear seam line between the right and left back body fabrics comprising the parts 66, 67, 68, 69, 70, and 71. Numerals 74 denote straps.

The ground stitches of the center front part 61, the side front and abdomen covering part 63, and the front hem part 65 are the strong satin type net. The ground stitches of the lower breast and upper abdomen covering part 62 and the lower and side abdomen covering part 64 are a mesh type net. In these parts 61, 62, 63, 64 and 65, nylon yarn of 40 denier is used in the ground stitch, and one polyurethane yarn of 140 denier is inserted.

The ground stitches of the back covering part 66, the upper hip covering part 68, and the main hip covering part 69 are a mesh type net, the ground stitches of the side and back waist covering part 67 and rear hem part 71 are the strong satin type net, and the ground stitch of the lower hip covering part 70 is the weak satin type net. In these parts, nylon yarn of 40 denier is used in the ground stitch. With regard to the insert yarn, one polyurethane yarn of 140 denier is inserted in the parts 66, 69 and 70, and two polyurethane yarns of 140 denier are inserted in the parts 67, 68 and 71.

According to this embodiment, the breasts are kept in an upward profile and are moved toward the center front by the part 60*b*, so that the breasts can be controlled to a fine shape. The part 61 is prevented from stretching in the lateral direction when worn because of its strengthened straining force, so that the breasts are prevented from moving toward the sides. Furthermore, superfluous flesh of the abdomen and of the side and lower breast is prevented from swelling by the strengthened straining force of the part 63; the waist is prevented from sagging by the strengthened straining force of the part 67 to form a neat waist line; natural roundness of the bulge of the hips is developed and the hips are kept in a high position by the part 69 with a relatively weak straining force and by the part 70 with a relatively strong straining force; and a fine line of the wearer's legs can be developed by firmly holding the wearer's thighs by the parts 65 and 71 having a further strong straining force.

Also, a garment having substantially no difference in level at a boundary between portions having different straining forces, thus being free of a problem in which a difference in level is reflected in an outer wear and is seen from outside thereof, keeping a wearer's fine appearance, and also having a required figure control function, can be provided. Furthermore, compared with a garment coated with a synthetic resin solution, breathability is not reduced, stuffiness is difficult to develop, and skin touch is not deteriorated. Moreover, compared with a circular knit fabric, finished dimensions are stable, products with same finished dimensions can be easily manufactured on a large scale, durability is good, and productivity is excellent.

Moreover, the above-mentioned embodiment may be more or less modified as needed to be applied to a swim suit, leotard, or the like.

Figure 24:
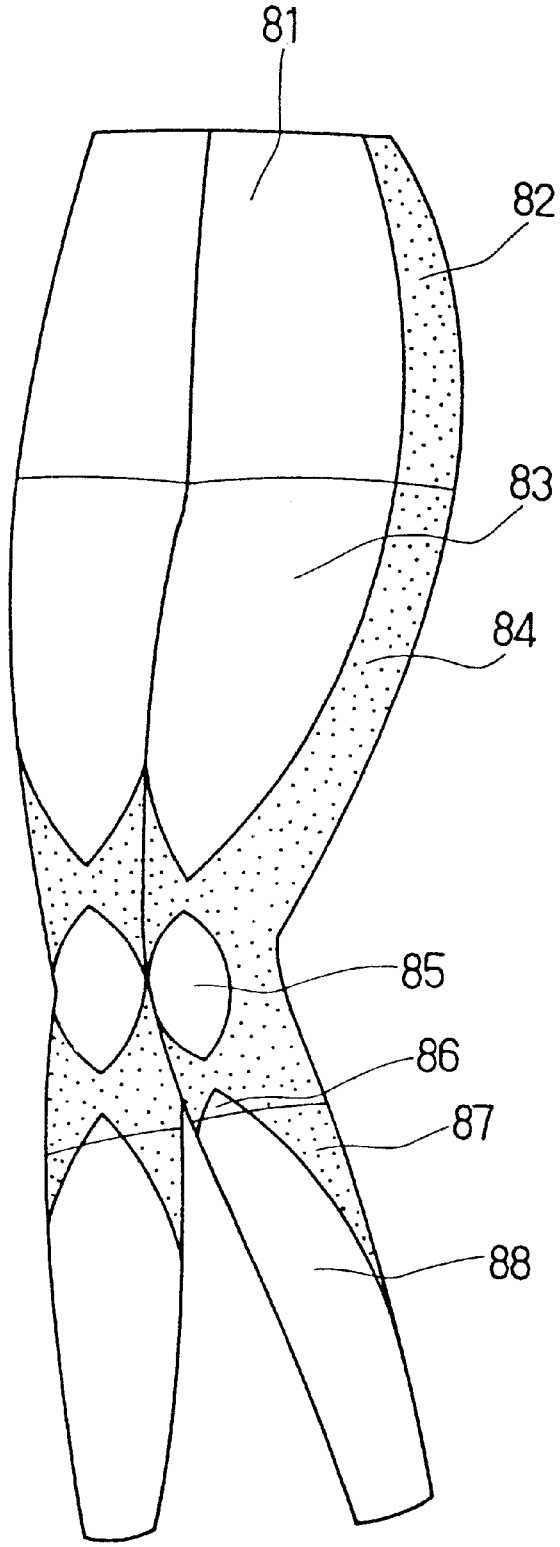
FIG. 24 is a perspective view from the front side of long type sports tights as garments of the present invention.
Figure 25:
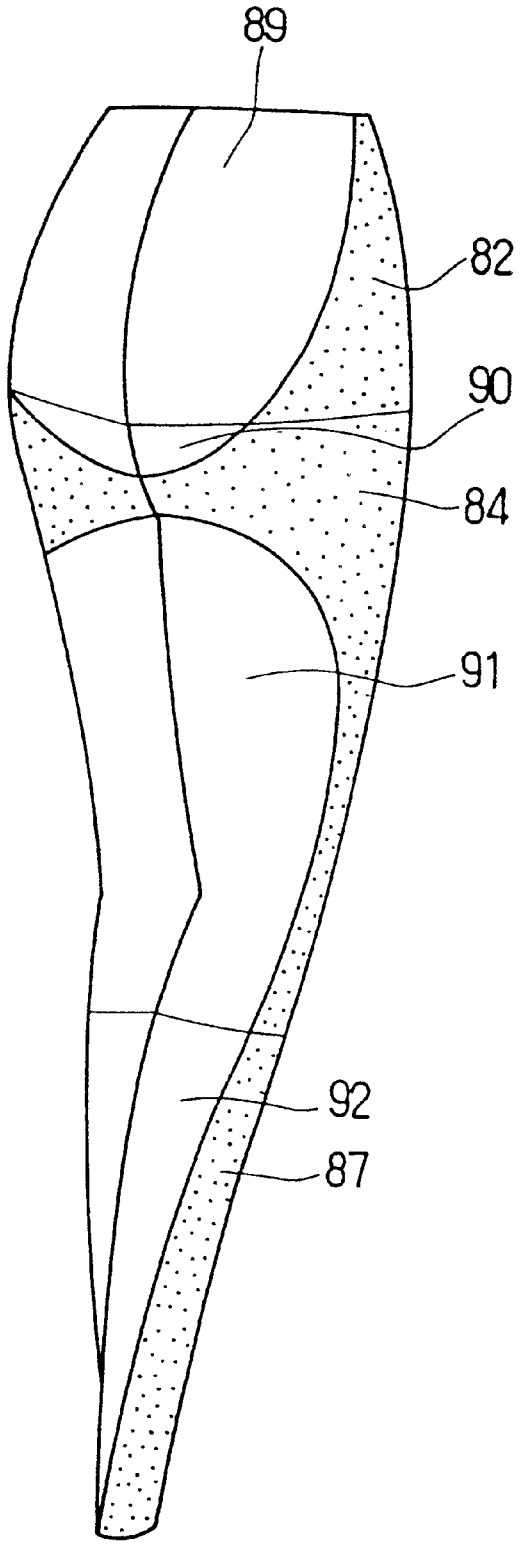
FIG. 25 is a perspective view from the back side of the long type sports tights shown in FIG. 24.

Next, FIG. 24 shows a perspective view from the front side of long type sports tights as garments of the present invention; and FIG. 25 shows a perspective view from the back side thereof.

This embodiment is configured so that portions with relatively strong straining forces may be provided to correspond to the lateral sides of the wearer's legs to support muscles such as musculus vastus lateralis and musculus rectus femoris, and to the medial sides of the wearer's legs to support muscles such as musculus vastus medialis, and to cover from beneath the bulge of the right and left hips to the sides of a wearer's body, and both sides of musculus gastrocnemius. Also, it is configured so that muscle belly of regio femoris anterior muscle group comprising musculus rectus femoris and musculus vastus medialis, musculus gastrocnemius, and the like, and knee joints may be covered by portions with relatively weak straining forces. According to this embodiment, these muscles are strongly supported from their one or both sides without inhibiting their activities during sports playing or the like, flow of blood or lymph is further promoted, and fatigue-causing substances such as lactic acid produced by muscle activities can be more rapidly removed from these muscles and muscle group. Thus is provided a garment with a muscle support function, which is provided with functions for reducing and preventing muscle fatigue.

In FIGS. 24 and 25, numerals 81 and 83 indicate parts for covering muscle belly of regio femoris anterior muscle group comprising musculus rectus femoris and musculus vastus medialis, etc; numeral 85 indicates a part for covering the knee; numerals 86 and 88 indicate parts for covering the shins; numerals 89 and 90 indicate parts for covering a main part of the hips; numeral 91 indicates a part for covering muscle belly of regio femoris posterior muscle group; numeral 92 indicates a part for covering belly of muscles such as musculus gastrocnemius etc.; numerals 82, 84, and 87 indicate parts for covering a muscle group in regio femoris lateralis comprising trochanter major and its vicinities, musculus vastus lateralis, etc., and a region from beneath the bulge of the right and left hips to the sides of the wearer's body, and a side of musculus gastrocnemius.

Moreover, because such sports tights have somewhat strong straining forces as a whole, the weak satin type net is also employed for the ground stitch in a portion with a relatively weak straining force, and the strong satin type net is used for the ground stitch in a portion which requires a further strong straining force.

The ground stitches of the parts 81, 83, 85, 86, 88, 89, 90, 91 and 92 are the weak satin type net comprising nylon yarn of 40 denier, and the ground stitches of the parts 82, 84 and 87 are the strong satin type net comprising nylon yarn of 40 denier. Moreover, with respect to the insert yarn, one polyurethane yarn of 210 denier is inserted in the parts 81, 82, 89, 87, 88 and 92; and one polyurethane yarn of 420 denier is inserted in the parts 83, 84, 85, 86, 90 and 91.

According to this embodiment, a garment having substantially no difference in level at a boundary between portions having different straining forces, thus not deteriorating a wearer's appearance, and is also provided with a required figure control or muscle support function. Furthermore, compared with a garment coated with a synthetic resin solution, breathability is not reduced, stuffiness is difficult to develop, and skin touch is not deteriorated. Moreover, compared with a circular knit fabric, finished dimensions are stable, products with same finished dimensions can be easily manufactured on a large scale, durability is good, and productivity is excellent.

Moreover, this embodiment may also be applied to spats or the like, for example, by appropriately changing the patterns of the portions with relatively strong and weak straining forces as needed.

Figure 26:
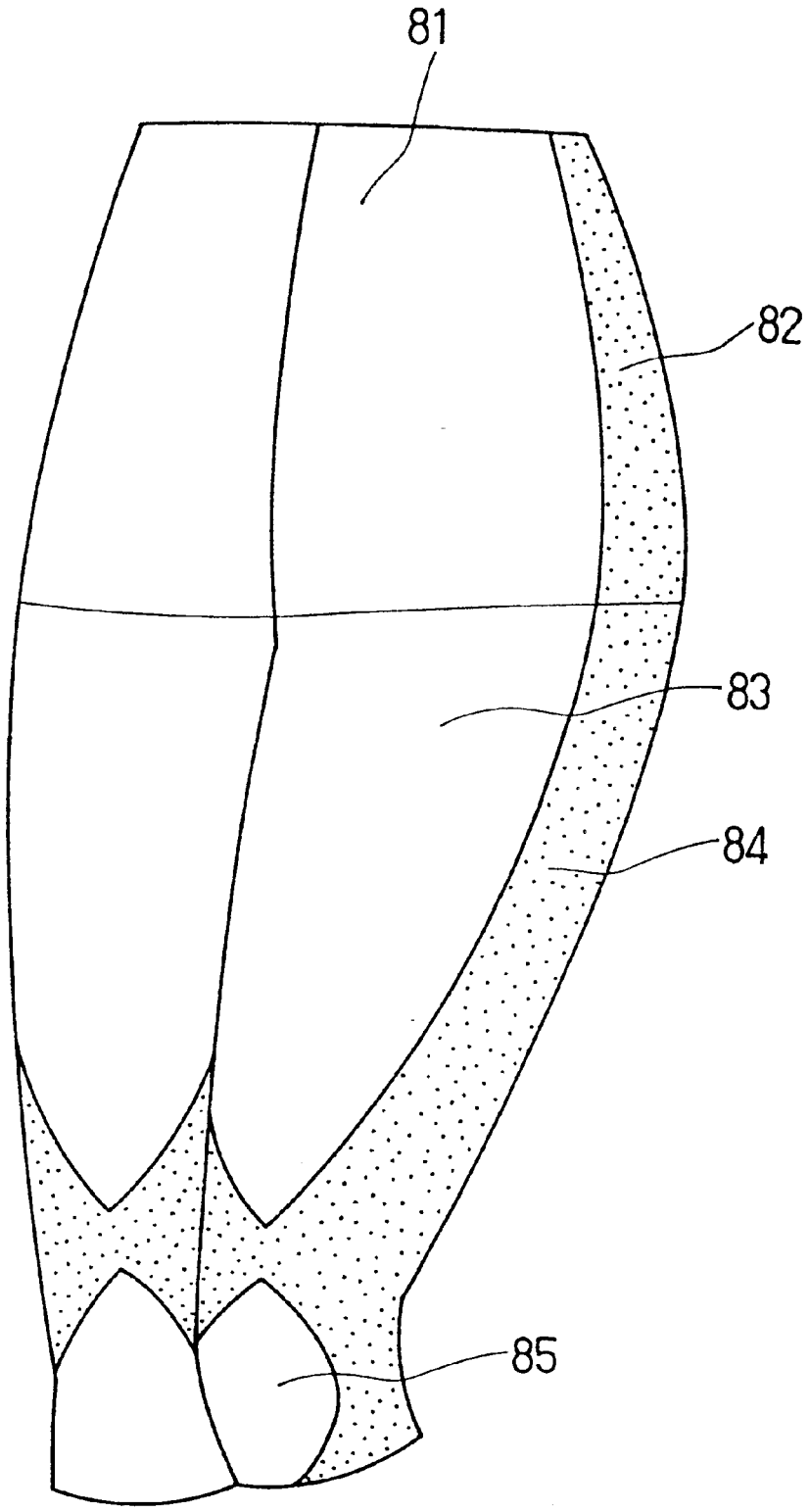
FIG. 26 is a perspective view from the front side of below-knee length sports tights as garments of the present invention.
Figure 27:
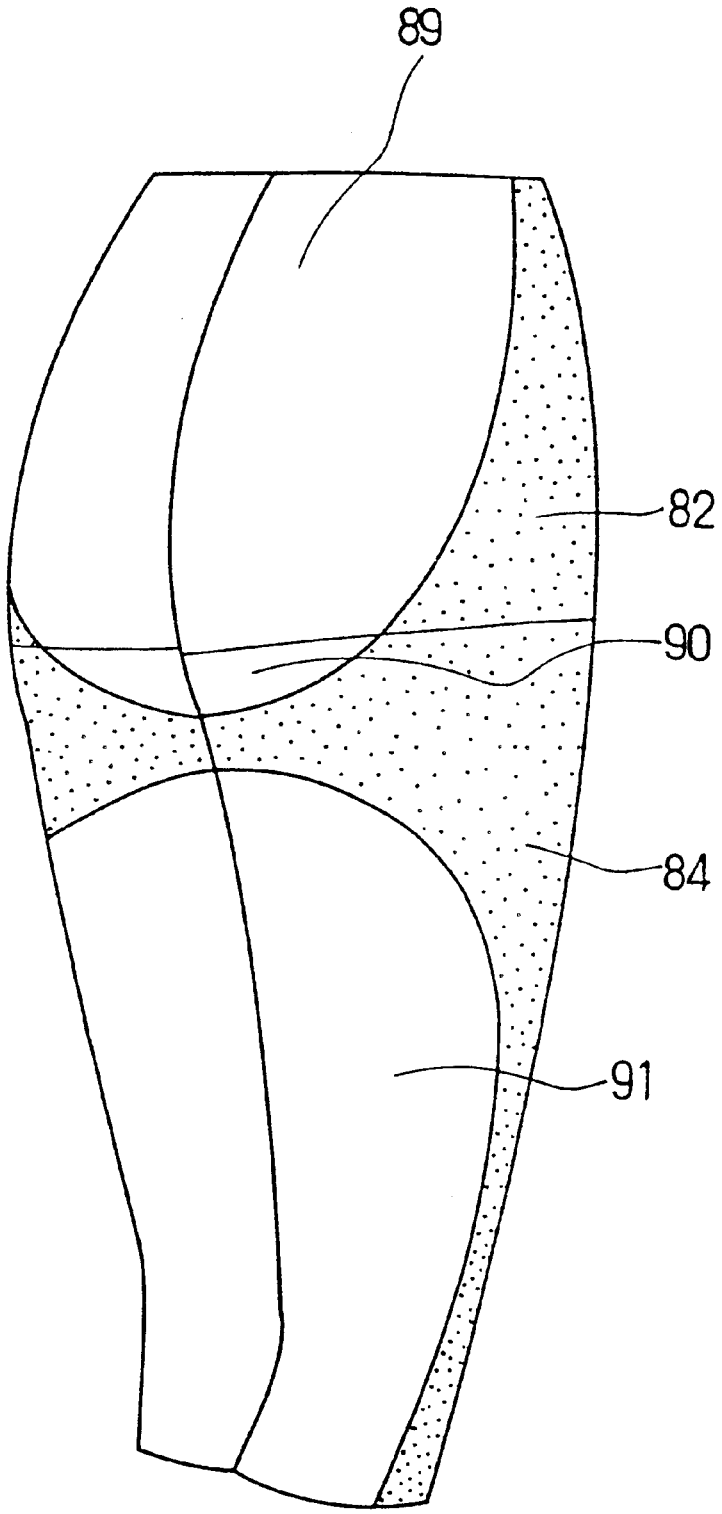
FIG. 27 is a perspective view from the back side of the sports tights shown in FIG. 26.

Next, FIG. 26 shows a perspective view from the front side of below-knee length sports tights as garments of the present invention; and FIG. 27 shows a perspective view from the back side thereof.

The sports tights shown in FIGS. 26 and 27 are essentially a below-knee length short type design modified from the sports tights shown in FIGS. 24 and 25. Therefore, the same reference signs are used to designate the same parts as in the sports tights shown in FIGS. 24 and 25, and individual explanation of these parts is omitted.

In order to provide this sports tights with somewhat weaker straining forces than the sports tights of FIGS. 24 and 25 as a whole, the types of the ground stitch and the insert yarn used in respective parts are modified as follows.

The ground stitches of the parts 81, 83, 85, 89, 90 and 91 are a mesh type net comprising nylon yarn of 40 denier, and the ground stitches of the parts 82 and 84 are the weak satin type net comprising nylon yarn of 40 denier. Furthermore, with respect to the insert yarn, one polyurethane yarn of 140 denier is inserted in the parts 81, 82 and 89, and two polyurethane yarns of 140 denier are inserted in the parts 83, 84, 85, 90 and 91.

Such an embodiment can provide a garment with a muscle support function, which strongly support the muscles in the femoral region from their one or both side without inhibiting the activities of these muscles during sports playing etc., thus further promoting flow of blood or lymph, so that fatigue-causing substances such as lactic acid produced by muscle activities can be removed from the muscles or muscle group more speedily, and thus has a function for reducing and preventing muscle fatigue.

Also, this embodiment can provide a garment having substantially no difference in level at a boundary between portions having different straining forces, thus not deteriorating a wearer's appearance, and also having a required figure control or muscle support function. Furthermore, compared with a garment coated with a synthetic resin solution, breathability is not reduced, stuffiness is difficult to develop, and skin touch is not deteriorated. Moreover, compared with a circular knit fabric, finished dimensions are stable, products with same finished dimensions can be easily manufactured on a large scale, durability is good, and productivity is excellent.

Moreover, this embodiment may also be applied to spats or the like, for example, by appropriately changing the patterns of the portions with relatively strong and weak straining forces as needed.

Figure 28:
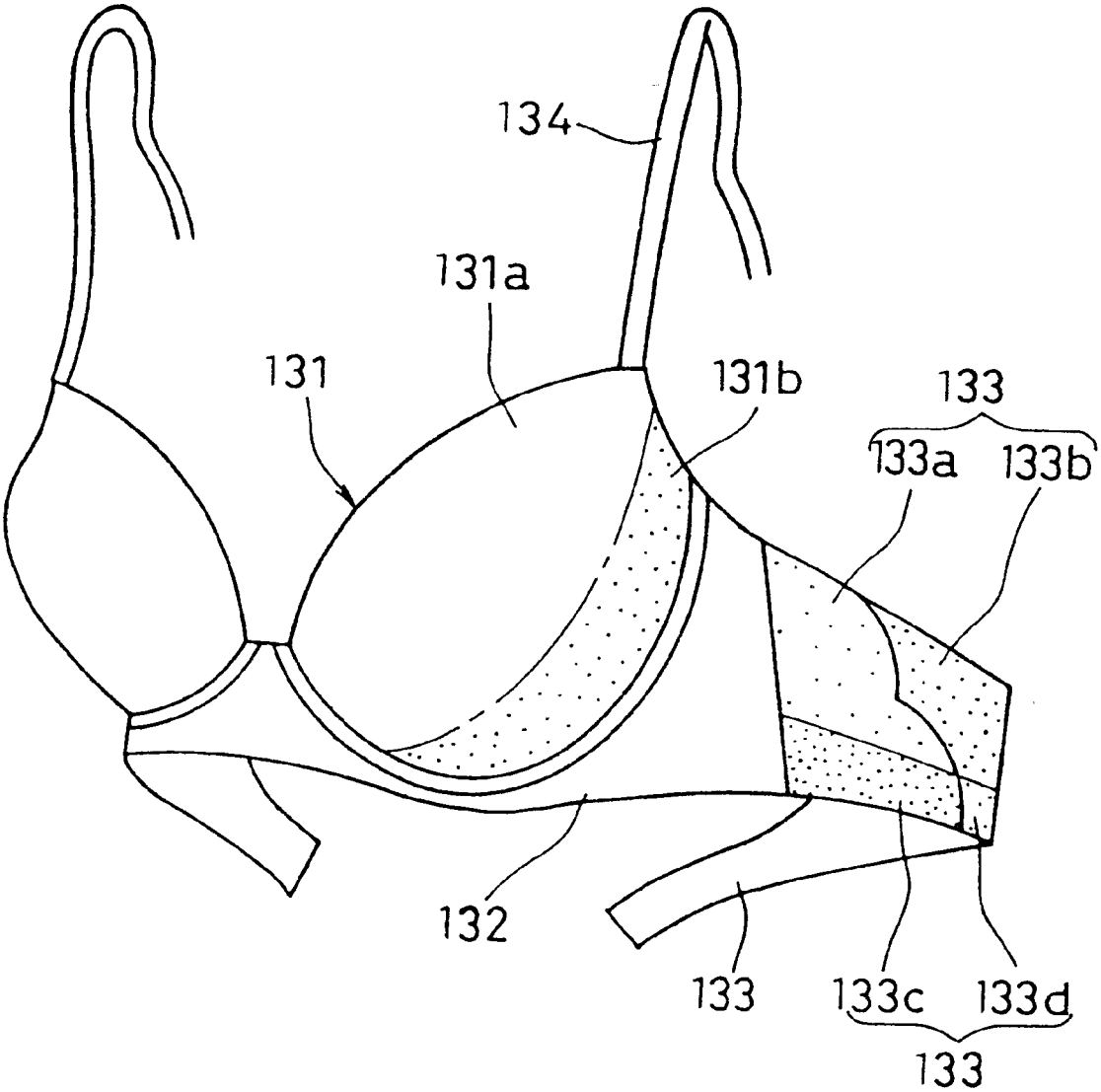
FIG. 28 is a perspective view from the front side of a brassiere as a garment of the present invention.
Figure 29:
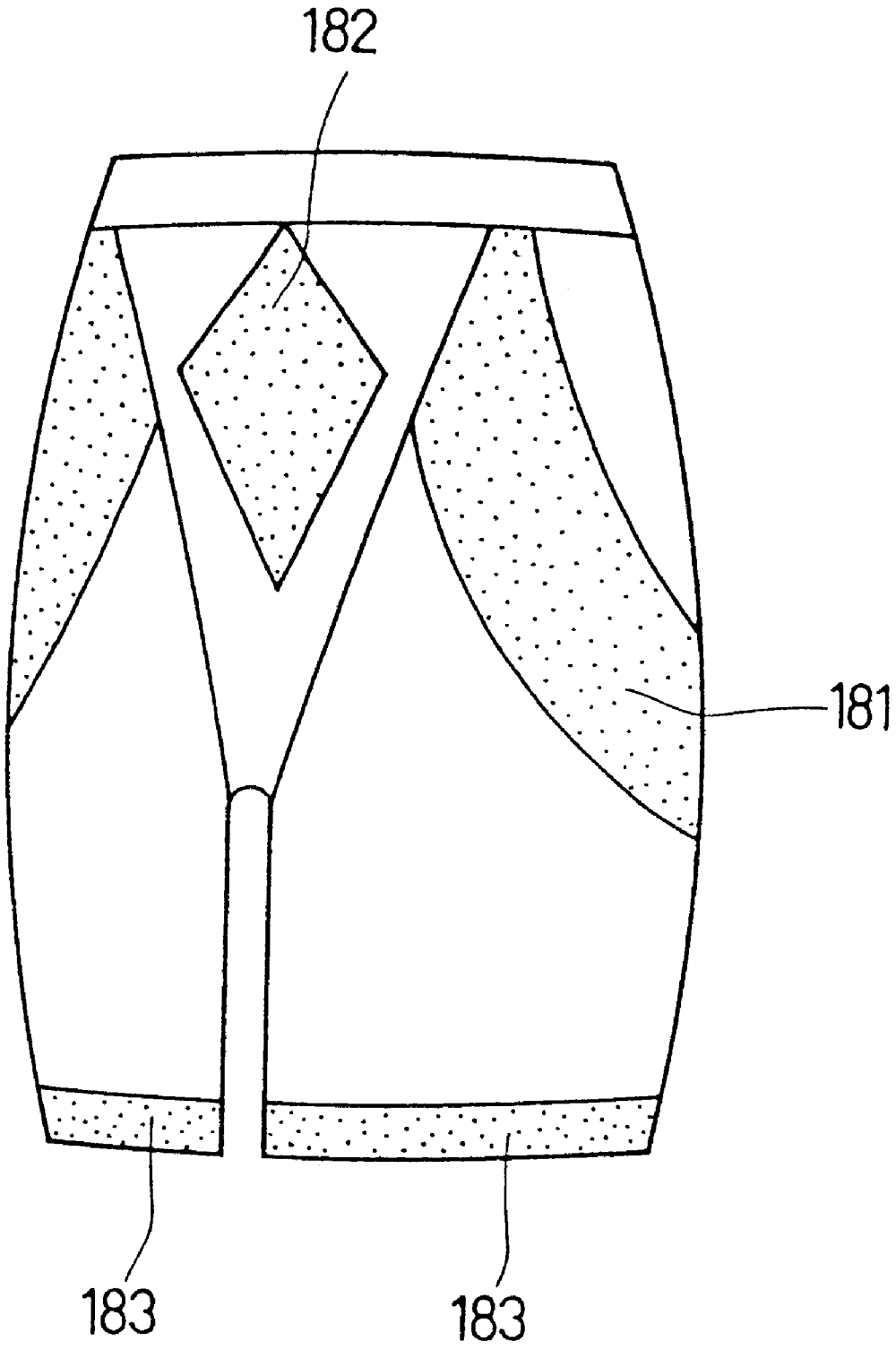
FIG. 29 is a perspective view from the front side of a conventional long type girdle.
Figure 30:
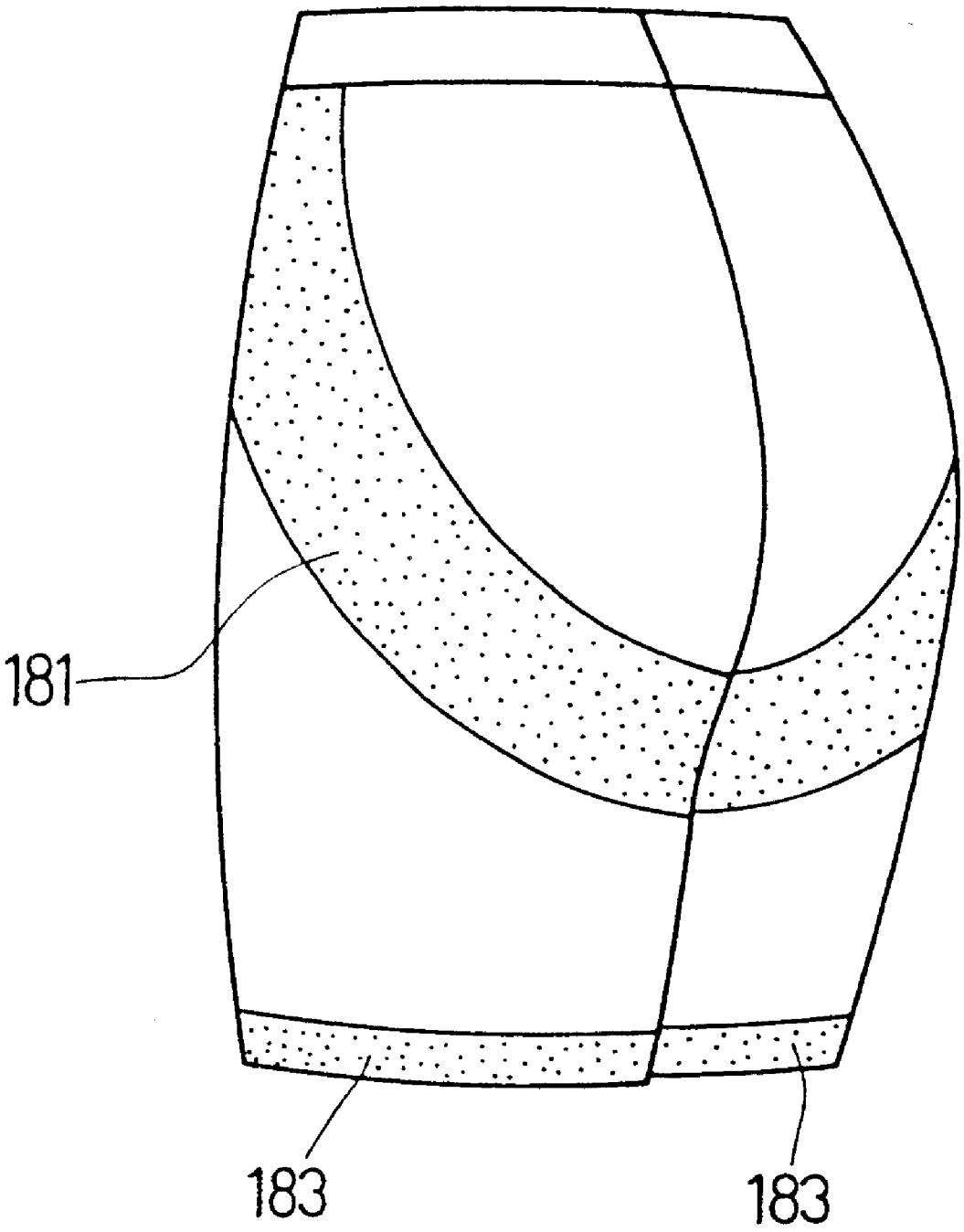
FIG. 30 is a perspective view from the back side of the long type girdle shown in FIG. 29.

Next, FIG. 28 shows a perspective view from the front side of a brassiere as a garment of the present invention. In this example of brassiere, the technique of the present invention that portions with relatively strong and weak straining force are provided in patterns, is applied to the cups of the brassiere and to portions of the back cloth piece that corresponds to the sides of a wearer's body. Numeral 131 denotes a cup of the brassiere; numeral 132 denotes a ground cloth piece; numeral 133 denotes a back cloth piece; and numeral 134 denotes a strap.

In this brassiere, the ground stitch of a part 131*b* from a lower region to the side of the cup 131 is the satin type tricot having a racking of three needles in large proportion as explained in FIG. 7 comprising nylon yarn of 30 denier, in which one polyurethane elastic yarn of 120 denier is knitted in each wale. The polyurethane yarn is knitted in such a way as shown in FIG. 14. The ground stitch of an upper part 131*a* of the cup 131 is the mesh type tricot shown in FIG. 10 comprising nylon yarn of 30 denier, in which one elastic polyurethane yarn of 120 denier is knitted in each wale. Furthermore, in a portion of the back cloth piece that corresponds to the side of a wearer's body, the ground stitches of parts 133*a* and 133*c* are the satin type tricot stitch having a racking of three needles in large proportion as explained in FIG. 7, and the ground stitches of parts 133*b* and 133*d* are the satin type tricot stitch as explained in FIG. 9. In the parts 133*a* and 133*b*, one polyurethane elastic yarn of 240 denier is knitted in each wale. Also, in the parts 133*c* and 133*d*, two polyurethane elastic yarns of 240 denier are knitted in each wale.

According to this embodiment, the breasts are kept in an upward profile and are also moved toward the center front by the part 131*b*, so that the breast can be controlled to a fine shape. Furthermore, superfluous flesh of the side breast is prevented from swelling by the parts 133*a*, 133*b*, 133*c* and 133*d*, so that a neat and slim line of the breasts can be achieved. The part 131*a* falls in the class of a portion with a relatively weak straining force, and the parts 133*a*, 133*b*, 133*c* and 133*d* fall in the class of the portion with a relatively strong straining force. Moreover, the part 133*c* has the strongest straining force, and the part 131*a* has the weakest straining force. Also, a brassiere having substantially no difference in level at a boundary between portions having different straining forces, thus being free of a problem in which a difference in level is reflected in an outer wear and is seen from outside of the outer wear, keeping a wearer's fine appearance, and also having a required figure control function, can be provided. Furthermore, compared with a brassiere coated with a synthetic resin solution, breathability is not reduced, stuffiness is difficult to develop, and skin touch is not deteriorated.

In the example of the brassiere described above with reference to FIG. 19, the ground stitches are formed by combining satin type net stitches and mesh type net stitches on the jacquard raschel knitting machine. However, as in such a brassiere explained in FIG. 28, the ground stitches may also be formed by combining satin type tricot stitches and mesh type tricot stitches on the jacquard raschel knitting machine. Also, with regard to the various above-mentioned garments other than brassiere, although in the above-mentioned examples the ground stitches are formed by combining satin type net stitches and mesh type net stitches on the jacquard raschel knitting machine, they may also be formed by combining satin type tricot stitches and mesh type tricot stitches on the jacquard raschel knitting machine. Among these examples, with regard to various garments other than brassiere, it is more preferable to use a combination of satin type net stitches and mesh type net stitches on the jacquard raschel knitting machine, in which elastic yarn is further inserted. In the case of brassiere, not only the above-mentioned net stitch combination, but also a combination of satin type tricot stitches and mesh type tricot stitches on the jacquard raschel knitting machine, in which elastic yarn is further knitted, may be preferably used.

Furthermore, although to provide a pattern for improving aesthetic appeal is not mentioned in the above embodiments, as long as the objects of the present invention are essentially accomplished, knitting stitches may be modified as appropriate. For example, small patterns such as floral patterns often used in women's garments may be applied appropriately. This is preferable, since it enables to finish the garment with further improved aesthetic appeal. Moreover, continuous small patterns of appropriate multiple small patterns such as floral patterns densely formed and connected therebetween may be formed, in a portion with a relatively strong straining force having "a band-shaped and curved large continuous pattern", for example, in those shown in FIGS. 1 and 2. Of course, application of such continuous small patterns are not limited only to the band-shaped patterns in FIGS. 1 and 2, but they may also be applied to other embodiments.

Also, in the present invention, portions with relatively strong and weak straining forces can be formed in predetermined places in any desired patterns by the above-mentioned method, for example, by changing the ground stitch. Therefore, one characteristic of the present invention is that a band-shaped, curved large continuous pattern not parallel to the walewise direction, such as one indicated by numeral 2 in FIG. 1, which is hardly seen in conventional patterns, can be realized. Therefore, portions with relatively strong and weak straining forces can be formed in predetermined places in predetermined patterns depending on the required strength of the straining forces.

It has been practically difficult to knit the above-mentioned portion with a relatively strong straining force in a band-shaped, curved continuous pattern by warp knitting using a conventional old warp knitting machine. However, for example, by using such a method previously described with reference to FIGS. 1 and 2, the ground stitch can be easily changed without limitation in the width or length direction, and the straining force can also be relatively freely changed without limitation in the width or length direction. It is difficult to achieve a curved continuous pattern using a conventional old warp knitting machine, and practically only a linear continuous band-shaped pattern parallel to the length direction have been able to be realized.

Moreover, the strength of the straining forces in the portions with relatively strong and weak straining forces may be determined as appropriate depending on the type of the garment, the position in the garment, and preferences of a wearer, and thus is not particularly limited. This is also apparent from the above-mentioned examples, such as the sports tights in FIGS. 26 and 27, which have somewhat weaker straining force than the sports tights in FIGS. 24 and 25 as a whole. That is, the straining forces in the respective parts of the sports tights shown in FIGS. 26 and 27 may also be somewhat stronger than, or approximately the same as, those of the sports tights shown in FIGS. 24 and 25 as a whole.

Thus, although the specific value of the straining force is not particularly limited, it is preferable that the straining force in a portion with a relatively strong straining force is selected from the range of 100 to 250 gf in the longitudinal direction of the material (walewise direction) as appropriate. It is also preferable that the straining force in a portion with a relatively weak straining force is selected from the range of 30 to 150 gf in the longitudinal direction of the material (walewise direction) as appropriate.

The straining force is measured by the following tensile test.

A test piece with a size of width 2.5 cm×length 16.0 cm is prepared so that the longitudinal direction of the material (walewise direction) may be equivalent to the length direction of the test piece. The test piece is turned so that its length direction may become equivalent to the vertical direction, and is gripped at its both ends with clips. With the upper grip length of 2.5 cm, the lower grip length of 3.5 cm, and thus the free length of the test piece between grip of 10.0 cm, the test piece is attached to Constant-Rate Extension tensile tester (manufactured by Shimadzu Corporation, "AUTOGRAPH" AG-500D). The test piece is stretched to 80% extension at a rate of 30±2 cm/min, while the stress applied to the test piece at a point of 30% extension is recorded as the stretching power (gf). Then, the test piece stretched to 80% extension is released from the stress applied, so that it contracts to return to its original length. The stress applied to the test piece when it recovers to 30% extension is determined as the straining force (gf).

It is arranged so that these values are automatically recorded by the above-mentioned tensile tester. Moreover, with regard to both stretching power and straining force, average values of the measured data for two test pieces are calculated, and determined as the stretching power and the straining force, respectively.

The extension percentage (%) herein used is expressed by the value of $[(d-e)/e]\times 100$, wherein (d) is the length of a stretched test piece in the stretch direction, and (e) is the original length of the test piece before being stretched (i.e. free length of the test piece between grip).

Moreover, it is preferable to use a test piece having the above-mentioned size when measuring the stretching power or straining force. However, if a sample of such a size cannot be cut out from a garment to be measured, a smaller size may also be employed. However, the smaller the size of the sample, the larger error of the measurement results. Thus, it is preferable to use in the measurement a sample having the largest size within the range capable to be cut out.

The Table 1 below shows specific data for some parts of the girdle shown in FIGS. 15 to 17 measured by the above-mentioned method.

[Table 1]

Part 22*g* in FIG. 17
- Ground Stitch: weak satin type net comprising nylon yarn of 40 denier.
- Insert Yarn: two polyurethane yarns of 140 denier.
- Stretching Power: 310 gf Straining Force: 168 gf Part 23*k* in FIG. 17
- Ground Stitch: mesh type net comprising nylon yarn of 40 denier.
- Insert Yarn: one polyurethane yarn of 140 denier.
- Stretching Power: 84 gf Straining Force: 46 gf Part 24*m* in FIG. 17
- Ground Stitch: mesh type net comprising nylon yarn of 40 denier.
- Insert Yarn: two polyurethane yarns of 140 denier.
- Stretching Power: 281 gf Straining Force: 159 gf Part 24*n* in FIG. 17
- Ground Stitch: strong satin type net comprising nylon yarn of 40 denier.
- Insert Yarn: two polyurethane yarns of 140 denier.
- Stretching Power: 368 gf Straining Force: 207 gf Part 23*e* in FIG. 17
- Ground Stitch: strong satin type net comprising nylon yarn of 40 denier.
- Insert Yarn: one polyurethane yarn of 140 denier.
- Stretching Power: 116 gf Straining Force: 58 gf The garment having a figure control or muscle support function according to the present invention has the following effects.

In the present invention, as previously described in detail in the embodiments of the present invention, portions with relatively strong and weak straining forces can be formed in predetermined places in desired patterns by changing the ground stitch. Thus, a band-shaped, relatively large curved continuous pattern not parallel to the walewise direction, which has not been seen in conventional warp knitting, can be accomplished. Thus, portions with relatively strong and weak straining forces can be provided in predetermined places in predetermined patterns, depending on the required strength of the straining forces.

By applying the above-mentioned techniques, the present invention can provide a garment having substantially no difference in level at a boundary between portions with large and small straining forces, and thus being free of a problem that difference in level is reflected in an outer wear and is seen from outside thereof, keeping a wearer's fine appearance, and also having with a required figure control or muscle support function. In addition, the garment of the present invention is free of problems such as deteriorated skin touch and decreased wearing comfort caused by seam lines formed when strengthened pieces are sewn to the main part of the garment to form portions with relatively strong straining forces. Moreover, the present invention can provide a garment with a figure control or muscle support function, in which breathability is not reduced, stuffiness is difficult to develop, and skin touch is not deteriorated, compared with a garment that is coated with a synthetic resin solution to have an additional straining force. Furthermore, the present invention can provide a garment with a figure control or muscle support function, in which finished dimensions are stable, products with same finished dimensions can be easily manufactured on a large scale, durability is good, and productivity is excellent, compared with a circular knit fabric. Moreover, since the garment of the present invention can have a higher gauge than a circular knit product, a portion having a further strong straining force among the portions with relatively strong straining forces can also be easily produced.

INDUSTRIAL APPLICABILITY

Because of the above-mentioned effects, the garment of the present invention can be effectively used for garments such as girdle, short panty, body suit, swim suit, leotard, brassiere, spats, sports tights, and others having a figure control or muscle support function.

What is claimed is:

1. A garment with a figure control or muscle support function comprising:

a warp knit fabric;

said warp knit fabric having ground stitches by jacquard knitting;

said warp knit fabric being knitted from inelastic yarn;

an elastic yarn inserted and/or knitted in said warp knit fabric;

said garment including a portion with a relatively strong straining force and a portion with a relatively weak straining force forming predetermined patterns;

said relatively strong and weak straining forces being produced by differences in stitches appearing on a face side of said ground stitches;

at least one of said predetermined patterns is a band-shaped and curved continuous pattern.

2. A garment with a figure control or muscle support function comprising:

a warp knit fabric;

said warp knit fabric having ground stitches by jacquard knitting;

said warp knit fabric being knitted from inelastic yarn;

an elastic yarn inserted in said warp knit fabric;

said garment including a portion with a relatively strong straining force and a portion with a relatively weak straining force forming predetermined patterns;

said relatively strong and weak straining forces being produced by differences in stitches appearing on a face side of said ground stitches;

at least one of said predetermined patterns is a band-shaped and curved continuous pattern.

3. A garment with a figure control or muscle support function according to claim 1 or 2, wherein a number and/or a thickness of said inserted and/or knit-in elastic yarn are changed to produce said relatively strong and weak straining forces.

4. A garment with a figure control or muscle support function according to claim 1 or 2, wherein the stitches appearing on a face side of said ground stitches by jacquard knitting comprise a combination of satin type net and mesh type net stitches.

5. A garment with a figure control or muscle support function according to claim 1 or 2, wherein said portion with a relatively strong straining force comprises a satin type net stitch and said portion with a relatively weak straining force comprises a mesh type net stitch in the stitches appearing on a face side of said ground stitches by jacquard knitting.

6. A garment with a figure control or muscle support function according to claim 1, wherein the stitches appearing on a face side of said ground stitches by jacquard knitting comprise a combination of satin type tricot and mesh type tricot stitches.

7. A garment with a figure control or muscle support function according to claim 1, wherein said portion with a relatively strong straining force comprises a satin type tricot stitch and said portion with a relatively weak straining force comprises a mesh type tricot stitch in the stitches appearing on a face side of said ground stitches by jacquard knitting.

8. A garment with a figure control or muscle support function according to claim 1 or 2, wherein two elastic yarns are inserted and/or knitted in said portion with a relatively strong straining force, and one elastic yarn is inserted and/or knitted in said portion with a relatively weak straining force.

9. A garment with a figure control or muscle support function according to claim 1 or 2, further comprising:

a portion having a further strong straining force that is greater than said portion with a relatively strong straining force; and said portion with a further strong straining force including a satin type net stitch having a substantial portion including a racking of at least two needles in the stitches appearing on a face side of said ground stitches by jacquard knitting.

10. A garment with a figure control or muscle support function according to claim 1, further comprising:

a portion having a further strong straining force that is greater than said portion with a relatively strong straining force; and said portion with a further strong straining force including a satin type tricot stitch having a substantial portion including a racking of at least three needles in the stitches appearing on a face side of said ground stitches by jacquard knitting.

11. A garment with a figure control or muscle support function according to claim 1 or 2, wherein said portion with a relatively strong straining force includes said band-shaped and curved continuous pattern.

12. A garment with a figure control or muscle support function according to claim 1 or 2, wherein said ground stitches by jacquard knitting comprise nylon yarn of 20 to 80 denier.

13. A garment with a figure control or muscle support function according to claim 1 or 2, wherein said inserted and/or knit-in elastic yarn is polyurethane fiber yarn of 40 to 560 denier.

14. A garment with a figure control or muscle support function according to claim 1 or 2, wherein said garment is selected from the group consisting of a girdle, a short panty, a body suit, a swim suit, a leotard, a brassiere, spats, and sports tights.

15. A garment with a figure control or muscle support function according to claim 1 or 2, further comprising small patterns formed by knitting stitches.

16. A garment with a figure control or muscle support function according to claim 1 or 2, wherein:

said garment has a hip region; and said band-shaped and curved continuous pattern is included in said portion with a relatively strong straining force and is a part of said garment that in use covers from beneath a bulge of right and left hips to sides of a wearer's body.

17. A garment with a figure control or muscle support function according to claim 1 or 2, wherein:

said garment is a girdle;

said band-shaped and curved continuous pattern is included in said portion with a relatively strong straining force and is a part of said girdle that in use covers from beneath a bulge of right and left hips to sides of a wearer's body.

18. A garment with a figure control or muscle support function according to claim 17, wherein:

said garment is a girdle; and said portion with a relatively strong straining force comprises a part of said girdle that in use covers approximately a center of an abdomen of a wearer's body.

19. A garment with a figure control or muscle support function according to claim 1 or 2, wherein:

said garment is a brassiere; and said band-shaped and curved continuous pattern is included in said portion with a relatively strong straining force and is a part of said brassiere extending from a lower region to a side of a breast cup.

20. A garment with a figure control or muscle support function according to claim 19, wherein:

said garment is a brassiere; and said portion with a relatively strong straining force comprises a part of a back cloth piece of said brassiere that in use corresponds to sides of a wearer's body.

* * * * *